US006925659B2

(12) United States Patent
Sato et al.

(10) Patent No.: US 6,925,659 B2
(45) Date of Patent: Aug. 9, 2005

(54) FLUID JETTING DEVICE

(75) Inventors: Minoru Sato, Kitakyushu (JP); Makoto Hatakeyama, Kitakyushu (JP); Yasuo Hamada, Kitakyushu (JP); Yoshiyuki Kioi, Hyogo (JP)

(73) Assignee: Toto Ltd., Kitakyushu (JP)

( * ) Notice: Subject to any disclaimer, the term of this patent is extended or adjusted under 35 U.S.C. 154(b) by 57 days.

(21) Appl. No.: 10/470,525

(22) PCT Filed: Feb. 26, 2002

(86) PCT No.: PCT/JP02/01761

§ 371 (c)(1),
(2), (4) Date: Jul. 29, 2003

(87) PCT Pub. No.: WO02/068766

PCT Pub. Date: Sep. 6, 2002

(65) Prior Publication Data

US 2004/0074527 A1 Apr. 22, 2004

(30) Foreign Application Priority Data

Feb. 27, 2001 (JP) ..... 2001-052688

(51) Int. Cl.[7] ..... A47K 3/20

(52) U.S. Cl. ..... 4/420.4; 4/420.3; 4/447; 4/448

(58) Field of Search ..... 4/420.4, 420.3, 4/447, 448; 239/222.15, 222.11, 222.17, 222.21, 383, 389, 428.5

(56) References Cited

U.S. PATENT DOCUMENTS 4,989,786 A * 2/1991 Kranzle et al. ..... 239/240
5,328,097 A * 7/1994 Wesch et al. ..... 239/243
5,697,392 A * 12/1997 Johnson et al. ..... 134/176
6,254,014 B1 * 7/2001 Clearman et al. ..... 239/222.15

FOREIGN PATENT DOCUMENTS

| | | |
|---|---|---|
| EP | 0879644 A2 | 11/1998 |
| JP | 65419/1990 | 3/1992 |
| JP | 7-184820 | 7/1995 |
| JP | 8-246535 | 9/1996 |
| JP | 2000-8452 | 1/2000 |
| JP | 2000-008453 | 1/2000 |

* cited by examiner

*Primary Examiner*—Khoa D. Huynh
(74) *Attorney, Agent, or Firm*—Beyer Weaver & Thomas LLP

(57) ABSTRACT

A cleaning water jetting device 40 formed so as to rotate a nozzle by a fluid pressure and capable of reducing the size of the drive part of a pump for feeding fluid to a chamber and an operation cost, comprising an upper side through-hole 6A recessedly formed in edge shape provided in the ceiling of the chamber 2 and a bottomed concave part 43 formed in round hole shape provided in the bottom surface thereof, wherein the nozzle 4 is installed by inserting a reduced diameter part 7 on a nozzle tip side at the nozzle tip side into the upper side through-hole 6A and the bottom portion 44 into the concave part 43, and kept in such a state in the upper side through-hole 6A as to face a cleaning fluid jetting port 5 toward the outside of the through-hole, to be rotated, and to allow the position thereof to be changed in a nozzle axis O direction, and can be revolved around the center axis thereof in the tilted attitude relative to the center axis P of the upper side through-hole 6A.

30 Claims, 22 Drawing Sheets

Fig.1(b) CROSS SECTION OF A-A

FLUID JETTING DEVICE

TECHNICAL FIELD

The present invention relates to a fluid jetting device comprising a chamber for receiving fluid, and for jetting such supplied fluid from a fluid jetting spout.

BACKGROUND ART

As an example of this type of the fluid jetting device, a local cleansing device for cleansing parts (anus for example) of the human body is well known. With this kind of the local cleansing device, upon jetting the cleansing water from a single fluid jetting spout toward a part of the human body, ordinarily, it is desirable that the water contact area of the jetted cleansing water is in some measure made to be a broad area.

In order to fulfill this sort of demand, a method of rotating a nozzle arm having a nozzle built therein in a circular path (nozzle arm rotation method) or a method of driving the nozzle itself within a nozzle arm having such nozzle built therein (nozzle rotation method) may be adopted. Incidentally, with the former method, since it is necessary to simultaneously control the nozzle arm in two axes on orthogonal coordinates, a drive motor or the like is required for the respective axes, and this resulted in the enlargement of the device. Meanwhile, with the latter method, since the drive target is only the nozzle, this is preferable in that the device can be miniaturized for such portion. This kind of nozzle rotation method has been variously proposed, for example, in JP 2000-8453 A, and may be classified broadly into a type that drives the nozzle with electrical power and a type that drives the nozzle with cleansing water pressure. The latter is superior to the former in terms of energy conservation.

FIG. 1 is an explanatory diagram for explaining the structure conventionally adopted so as to rotatably drive the nozzle with cleansing water pressure, wherein FIG. 1(*a*) is an explanatory diagram illustrating a schematic cross section of the nozzle arm, and FIG. 1(*b*) is an explanatory diagram illustrating the schematic cross section of line A—A thereof.

As shown in FIG. 1, a truncated cone-shaped nozzle is rotatably built in the chamber of the nozzle arm, and a plurality of curved grooves is formed around the peripheral wall of the nozzle. This nozzle, at the tip side thereof, is sealed to the inner face of the chamber with a seal member. When cleansing water is supplied to this kind of nozzle, the nozzle rotates with the pressure of the cleansing water upon such cleansing water passing through the grooves between the inner face of the chamber and the peripheral wall of the nozzle. Thus, the nozzle jets cleansing water from the jetting spout at the nozzle tip so as to broaden the water contact area.

Nevertheless, with the foregoing conventional structure, since a seal member lies between the nozzle tip and inner face of the chamber, the nozzle is subject to a relatively large rotational resistance from the seal member during the rotation thereof.

Rotational speed of the nozzle affects the broadening of the cleansing water from the jetting spout, and a certain degree of rotational speed is required in order to broaden the water contact area. As a result, the water pressure upon supplying cleansing water must be increased in order to elicit and maintain the rotation of the nozzle, and problems such as the enlargement of the actuator of pumps or the like and increased operating costs would arise.

These problems are not typical to a cleansing water jetting device as represented with a local cleansing device, and, even with a fluid jetting device employed for other purposes, similar problems occur as a result of the structure of rotating the nozzle with fluid pressure.

The present invention was devised in view of the foregoing problems, and an object thereof is to seek, upon adopting the structure of rotating the nozzle with fluid pressure, the miniaturization of the actuator of a pump or the like for supplying fluid to the chamber, and the reduction of operating costs.

DISCLOSURE OF THE INVENTION

In order to solve the foregoing problems at least in part, a fluid jetting device of the present invention is characterized in that a fluid jetting device is structured to include a chamber for receiving fluid, and to jet the supplied fluid from a fluid jetting spout, the fluid jetting device comprises;

a nozzle built in the chamber, the nozzle having the fluid jetting spout at the nozzle tip side, and having a nozzle inner conduit for guiding the fluid supplied by the chamber to the fluid jetting spout, and a condensed diameter member of the nozzle tip side formed on the nozzle is rotatably inserted into an opening formed on the chamber and in a state where the position change of the nozzle toward the axial core direction of the nozzle is allowed, and the nozzle is structured to be revolvable around the central axis in a posture inclined against the central axis of the opening, when the fluid is supplied to the chamber, the nozzle changes its position toward the outer side of the nozzle tip by the force of fluid pressure, an end face of the nozzle portion having a larger diameter than the condensed diameter member contacts the chamber ceiling wall of the opening side, and the nozzle rotates around the axial core by the force of fluid pressure in such contact state and jets the fluid from the fluid jetting spout while revolving around the central axis in a posture inclined against the central axis.

With the fluid jetting device of the present invention having the foregoing structure, when the fluid is supplied to the chamber, the nozzle changes its position toward the outer side of the nozzle tip by the force of fluid pressure, and the end face of the nozzle portion having a diameter larger than the condensed diameter member on the nozzle tip side contacts the chamber ceiling wall on the opening side.

The nozzle adopting this kind of contact state jets fluid from the fluid jetting spout while rotating around the nozzle axial core and revolving around the central axis in a posture inclined against the central axis of the opening by the force of fluid pressure.

Thereby, the fluid jetted from the jetting spout becomes conical around the central axis of the chamber opening, and fluid can be jetted to a broad area as a result thereof. Moreover, the foregoing contact portion of the chamber ceiling wall and the end face of the nozzle portion having a diameter larger than the condensed diameter member can be sealed.

In this kind of sealed state, although slight, since there is space for fluid to seep between the chamber ceiling wall and the end face of the nozzle portion, this infiltrated fluid will function as a lubricant. Thus, since the resistance subjected by the end face of the nozzle portion from the chamber ceiling wall can be decreased, a favorable nozzle rotation is enabled even when the fluid pressure within the chamber is small. In other words, since the fluid pressure of the fluid supplied to the chamber can be kept low, the actuator of a pump or the like for supplying the fluid can be miniaturized and the operating cost can be reduced for such portion.

In addition, there are the following advantages.

With the nozzle arm rotation method of fixing the nozzle and rotating the nozzle arm in a circular path, the movement of the fluid jetting spout becomes slow since the object to be driven is large. Further, even with the conventional nozzle rotation method illustrated in FIG. 1, when the fluid pressure of the supplied fluid is low, the nozzle rotational speed, and ultimately the fluid jetting spout rotational speed becomes slow. Thus, in such a case, there is a problem in that the broadening range of the fluid jetted from the rotating fluid jetting spout will become small. Nevertheless, with the fluid jetting device of the present invention, even if the fluid pressure of the supplied fluid is low, the foregoing problem will not occur since high rotation can be maintained as a result of the rotational speed of the nozzle and fluid jetting spout not being reduced considerably.

With the fluid jetting device of the present invention described above, a guide for guiding the nozzle can be provided to the chamber so as to make the nozzle revolve around the central axis in a posture inclined against the central axis of the opening.

According to the foregoing structure, the nozzle guide stabilizes the inclination posture of the nozzle upon such nozzle revolving around the central axis of the opening. Moreover, by adjusting the guide in various ways, the nozzle inclination posture can be easily set to a desired posture. As a result of the above, fluid can be jetted conically in a stable manner around the central axis of the chamber opening, and such jetted fluid can be accurately jetted to a desired area of the target to be jetted.

Further, with the fluid jetting device of the present invention described above, at least one of the chamber ceiling wall and the end face of the nozzle portion having a diameter larger than the condensed diameter member can be formed in a sphere.

According to the foregoing structure, the rotational resistance subjected by the rotating and revolving nozzle from the chamber ceiling wall can be further reduced. Thus, since compatibility with low fluid pressure is enabled through the increase in the rotation efficiency of the nozzle, further miniaturization of the actuator and reduction of operating costs can be sought.

Moreover, in order to solve the foregoing problems at least in part, another fluid jetting device of the present invention is a device for jetting fluid from a fluid jetting spout, characterized in comprising:

a chamber for receiving the supply of fluid; and a nozzle built in the chamber, the nozzle having the fluid jetting spout at the nozzle tip side, and having a nozzle inner conduit for guiding the fluid supplied by the chamber to the fluid jetting spout, wherein the nozzle makes the fluid jetting spout locate to the outside of a ceiling opening formed on the chamber, adopts a posture inclined against the central axis of the ceiling opening upon making contact with one place of the chamber ceiling wall of the ceiling opening side and making contact with at least another place, and is built in the chamber revolvably around the central axis in the inclined posture, and when the fluid is supplied to the chamber, the nozzle jets fluid from the fluid jetting spout via the nozzle inner conduit while revolving around the central axis in a state of adopting the inclined posture by the force of fluid pressure of the supplied fluid.

With the additional fluid jetting device of the present invention having the foregoing structure, when the fluid is supplied to the chamber, the nozzle jets fluid from the fluid jetting spout via the nozzle inner conduit while revolving around the central axis in a state of adopting the inclined posture by the force of fluid pressure of the supplied fluid. Thus, fluid jetted from the fluid jetting spout of the nozzle becomes conical around the central axis of the chamber opening, which thereby enables the fluid to be jetted to a broad area.

This kind of inclined posture of the nozzle is realized as a result of the nozzle contacting the chamber ceiling wall and contacting another place, and both contacts becomes a so-called point contact. Therefore, in a certain instant while the nozzle is making the foregoing revolution, although the nozzle is contacting (point contact) the chamber ceiling wall on the side where the nozzle is inclined at the chamber ceiling opening, a gap is formed outside such contact portion around the ceiling opening. Here, the degree of the gap depends on the inclination of the nozzle.

At this gap portion around the ceiling opening, fluid leaks through within the chamber, and the position of this gap portion changes around the ceiling opening pursuant to the revolution of the nozzle in an inclined posture. Therefore, fluid leaking through the gap portion during the nozzle revolution will function as a lubricant. Thus, since the resistance subjected by the end face of the nozzle portion from the chamber ceiling wall can be decreased, a favorable nozzle rotation is enabled even when the fluid pressure within the chamber is small. In other words, as described above, the actuator of a pump or the like for supplying the fluid can be miniaturized and the operating cost can be reduced. In addition, a point contact occurs during the nozzle revolution, and such point contact portion changes with the nozzle rotation. As a result, since the resistance itself entailing the contact decreases, further miniaturization of the actuator and reduction of operating costs can be sought. Furthermore, since this is a point contact, the frictional force accompanying this contact can be reduced, and this is preferable from the perspective of abrasion prevention.

Moreover, since the rotation of the fluid jetting spout can be maintained at a high rotation even when the fluid pressure of the supplied fluid is low, the foregoing problem of the area to which fluid is jetted becoming narrow will not occur.

Further, since the inclined posture of the nozzle is realized by the nozzle making contact with the chamber ceiling wall and making contact with another place, under the condition where these contacts are being made, the inclination posture will be stable. If the supply of fluid to the chamber is of a high fluid pressure, the nozzle tries to incline even further, but the inclination posture at such time is maintained with the foregoing contacts. Thus, fluid can be jetted conically in a stable manner around the central axis of the chamber opening, and such jetted fluid can be accurately jetted to a desired area of the target to be jetted. Moreover, by adjusting the contact portion of another place as described above in various ways, the nozzle inclination posture can be easily set to a desired posture.

When the nozzle revolves within the chamber, at the chamber ceiling wall contact portion, the rotational resistance becomes small due to the fluid leaking through the gap as described above. Nevertheless, this rotational resistance acts as friction resistance against the nozzle since the nozzle is free within the chamber. Therefore, during the nozzle revolution, the nozzle rotates around its nozzle central axis;

that is, rotates on its axis, by the force of this friction resistance. When the nozzle rotates like this, the contact portion of the nozzle against the chamber ceiling wall changes around the rotational axis due to the nozzle rotating on its axis, thereby preventing portion of the nozzle from remaining in the status contacting the chamber ceiling wall. Thus, abrasion of the nozzle can be suppressed with certainty.

The additional fluid jetting device of the present invention described above is able to adopt various modes.

For instance, the nozzle may make contact with another place, which yields the inclined posture of the nozzle, by contacting the chamber side wall around the nozzle, and adopt the inclined posture at two places; namely, the chamber side wall contact portion and the chamber ceiling wall contact portion.

According to the foregoing structure, since the contact portion of the nozzle deviates from the chamber ceiling wall and the chamber side wall, stability of the inclined posture can be improved. Further, since the contact portion deviates as described above, even if the chamber ceiling opening is made to have a small diameter, the appearance and reproducibility of the nozzle inclination posture will not be affected. In addition, if the ceiling opening is made to have a small diameter, the gap portion around the ceiling opening also becomes small, and, while securing the lubricating function of the fluid leaking through the gap portion, the amount of this leaking fluid can be reduced.

In such a case, the following mode may also be adopted.

In other words, the nozzle has a nozzle tip with a diameter smaller than the ceiling opening, and a nozzle body having a diameter larger than the ceiling opening and continued to the nozzle tip, the nozzle tip protrudes outside from the ceiling opening so as to make the fluid jetting spout locate to the outside of the ceiling opening, and the nozzle adopts the inclined posture by making the step portion of the nozzle tip and the nozzle body contact the chamber ceiling wall, and making the nozzle body contact the chamber side wall.

According to the foregoing structure, the fluid jetting spout yielding the foregoing conical jetted fluid will be positioned outside the ceiling opening, and the nozzle tip will be positioned at such ceiling opening. Thus, the fluid leaking through the gap portion around the foregoing ceiling opening will not interfere with the fluid jetted from the fluid jetting spout. As a result, stabilization of the fluid jetted from the fluid jetting spout can be sought since turbulence will not occur to the conical jetted fluid.

Moreover, the following mode may also be adopted.

In other words, the nozzle has a nozzle tip with a diameter smaller than the ceiling opening, and a nozzle body having a diameter larger than the ceiling opening and continued to the nozzle tip, the nozzle tip protrudes outside from the ceiling opening so as to make the fluid jetting spout locate to the outside of the ceiling opening, the nozzle makes contact with the another place by contacting the ceiling opening wall around the nozzle, and adopts the inclined posture at two places of the ceiling opening wall contact portion and the chamber ceiling wall contact portion, and the nozzle tip contacts the ceiling opening wall, and the step portion of the nozzle tip and the nozzle body contacts the chamber ceiling wall.

According to the foregoing structure, the effects described above can be yielded as a result of positioning the fluid jetting spout outside the ceiling opening, in addition to yielding the following advantages.

The inclined posture of the nozzle occurs with the ceiling opening wall contact and the chamber ceiling wall face contact, and both of these contact portions are positioned with the ceiling opening positioned therebetween. Thus, by adjusting the diameter of the ceiling opening, the two contact portions can be separated or moved closer to adjust the nozzle inclination posture. Since the ceiling opening can be processed easily from outside the chamber, it is easy to adjust the nozzle inclination posture.

Moreover, even in the foregoing case, since the chamber ceiling opening can be made to have a small diameter, the gap portion around the ceiling opening can be reduced. Thus, upon securing the lubricating function, the amount of fluid leaking through the gap portion can be reduced.

Further, since contact is made to the ceiling opening wall with a small diameter nozzle, the peripheral velocity of the nozzle rotation can be slowed down for the portion such contact portion is made to have a small diameter. Thus, even if the same portion makes contact because the nozzle rotation is incomplete, since the peripheral velocity is slow, abrasion of such contact portion can be suppressed. Here, as a result of the lubrication effect yielded by the fluid leaking through the foregoing gap portion around the ceiling opening, abrasion of such contact portion can be further suppressed.

Moreover, in the foregoing case, the following mode may also be adopted.

In other words, the nozzle adopts the inclined posture by making contact with the ceiling opening wall and making contact with the chamber ceiling wall, as well as by making the nozzle body contact the chamber side wall.

According to the foregoing structure, since the inclined posture of the nozzle is based on three contact locations, the inclined posture can be secured even more stably. In addition, since the number of contact locations upon adopting the inclined posture increases, even if the fluid supplied to the chamber is of a high fluid pressure, fluid can be jetted conically in a stable manner by maintaining the nozzle inclination posture with even more certainty, and such jetted fluid can be accurately jetted to a desired area of the target to be jetted.

Moreover, the nozzle can be moved to the ceiling opening side to make contact with the chamber ceiling wall upon being subject to the fluid pressure entailing the supply of fluid to the chamber.

According to the foregoing structure, the nozzle becomes substantially free within the chamber at the initial state of supplying the fluid prior to the nozzle making contact with the chamber ceiling wall. Thus, the action of the fluid pressure entailing the supply of fluid thereafter increases, and the nozzle inclination position and the foregoing nozzle revolution can be realized more easily. As a result, the startability of revolution in the inclined posture can be increased thereby.

Further, the chamber ceiling wall can circularly protrude the contact portion with the nozzle. With this, since the nozzle contact only occurs in a circular protrusion, it is effective in the stabilization of the point contact upon contact and the prevention of abrasion described above. In addition, regarding the worn portion when the nozzle stops at the circular protrusion, the point contact state will also be stable due to the circular protrusion in the shape after the wear.

Moreover, the nozzle may have a shape of either a sphere or a taper at the contact portion with the chamber ceiling wall.

According to the foregoing structure, it is further effective in the stabilization of the point contact upon contact and the prevention of abrasion described above. In particular, when the nozzle is inclined, the gap portion around the ceiling opening can be made narrow, and the cleansing water leaking through this gap portion can be reduced. Thus, this can be utilized effectively upon jetting the cleansing water from the cleansing water jetting spout.

Further, if the nozzle has the nozzle inner conduit penetrating in the axial center direction of the nozzle, weight saving of the nozzle can be sought for the portion of the penetrating nozzle inner conduit. Thus, the inertia exhibited by the nozzle itself decreases and the inclined posture and nozzle revolution by the force of fluid pressure can be realized more easily, and the startability and rotational frequency thereof can be improved.

Here, the nozzle inner conduit on the side opposite to the fluid jetting spout could be made a tube path with a large diameter. With this, the nozzle becomes even more lightweight and the startability and rotational frequency can be improved thereby. In addition, since the nozzle inner conduit undergoes a narrowing transition upon the fluid passing through this nozzle inner conduit toward the fluid jetting spout, and rectification effect of the jetted cleansing water can be yielded as a result thereof.

Moreover, at least one of the chamber ceiling wall and the contact portion of the nozzle to the chamber ceiling wall may be formed of a material having wear resistance; for instance, a metal material.

According to the foregoing structure, wear involving the nozzle contact (point contact) can be suppressed and the heat release efficiency of the heat of abrasion arising at the time of such contact can be increased. Thus, melting and fixation by the heat of abrasion can be avoided, and the reliability of nozzle revolution, and ultimately the fluid jetting can be increased. Further, if the nozzle is formed of the foregoing metal material, the nozzle weight can be increased for such portion. As a result, the inertia exhibited by the nozzle increases, the centrifugal force during the nozzle revolution increases, and the stabilization of the nozzle inclination posture during such revolution can be sought thereby.

The fluid jetting device described above can be employed in various devices for cleansing objects to be cleansed by jetting cleansing water. For example, in addition to a human body part cleansing device and shower device, this may be employed in a portable human body part cleansing device to be carried along for cleansing human body parts. The foregoing fluid jetting device, upon revolving the nozzle in an inclined posture, does not require an actuator, or, needless to say, a power source or battery for driving such actuator. Thus, the fluid jetting device of the present invention is suitable for a portable human body part cleansing device which requires lightness in weight, compactness, and low cost.

With the human body part cleansing device employing the fluid jetting device of the present invention, since miniaturization of the actuator and reduction of operating costs described above are realized with the fluid jetting device itself built in the nozzle arm, even when this is employed in a human body part cleansing device, it is possible to seek the miniaturization of the nozzle arm itself as well as the device itself.

In particular, since the water contact area of the cleansing water jetted via the high-velocity rotation (revolution) of the nozzle can be changed at a high speed, even if a location that is sensitive to stimulation, such as a human body part, is the target of cleansing, the transition of the water contact area will be difficult to perceive, and an uncomfortable feeling will not occur during the cleansing.

Even with a shower device employing the fluid jetting device of the present invention, since the effect of miniaturization of the actuator and reduction of operating costs are yielded with the fluid jetting device, this is also suitable for a shower device. Moreover, since a special device and power source are not required as described above, this is suitable as a shower device in an environment where there is much moisture and rust or electric leakage can occur easily; for instance, in a bathroom. In addition, as a result of the high-speed transition of the water contact area of the foregoing jetted cleansing water, an uncomfortable feeling does not occur during the shower.

Further, with a washing device employing the fluid jetting device of the present invention; for instance, a dishwashing device for washing dishes, the nozzle of the fluid jetting device showers the jetted cleansing water in a conical shape toward the objects to be washed with the revolution of the nozzle. This kind of jetted cleansing water has a circular component resulting from the nozzle revolution, and, as described above, when the nozzle itself rotates around the nozzle axis, it also has the circular component arising from such rotation on its axis. Thus, according to the washing device of the present invention, in comparison to a case of the cleansing water contacting the object to be washed merely in a rectilinear propagation, the removal performance of stains adhered to the object to be contacted with water increases, and the improvement in washing performance can be sought thereby. As a result, water conservation improves in connection with the jetting of cleansing water to a broad area, and the increase in removal and washing performance.

In this type of washing device (dishwashing device), the foregoing fluid jetting device is mounted on a rotating arm rotatably disposed in a washing chamber. Upon such mounting, the fluid jetting devices are disposed at the tip portion of the rotating arm with the rotational axis therebetween, and cleansing water is supplied to the chamber of each of the fluid jetting devices. Then, each of the fluid jetting devices jets cleansing water from the nozzle while orienting toward the oblique direction against the rotating arm such that the reactive force produced with the jetting of cleansing water yields the same directional rotation to the rotating arm as the rotational axis rotation.

According to the foregoing structure, when cleansing water is jetted from the nozzle at the tip portion of the rotating arm (jetting by nozzle revolution), this rotatable arm rotates around the rotational axis, and is capable of thoroughly showering the dishes inside the washing chamber with the jetted water in an approximate conical shape by nozzle revolution. Thus, the washing performance of dishes can be improved thereby. In addition, since the rotating arm can be reduced in size through the miniaturization of the fluid jetting device itself, the expansion in the effective internal volume and the improvement of dishwashing efficiency of the dishwashing device can be sought thereby.

Moreover, the fluid jetting device of the present invention may also be employed as a device for washing the bathtub surface in addition to the foregoing dishwashing device. With this kind of bathtub washing device, the fluid jetting device of the present invention is provided to the surface of the bathtub, and emits a jet of chemicals or cleansing water to the opposite bathtub surface. With this, an advantage is yielded in that the cleansing water can be jetted to a broad area and a high washing effect can be realized. Further, since cleansing water is jetted to a broad area, water conservation can also be achieved.

BEST MODE FOR CARRYING OUT THE INVENTION

Figure 1A:
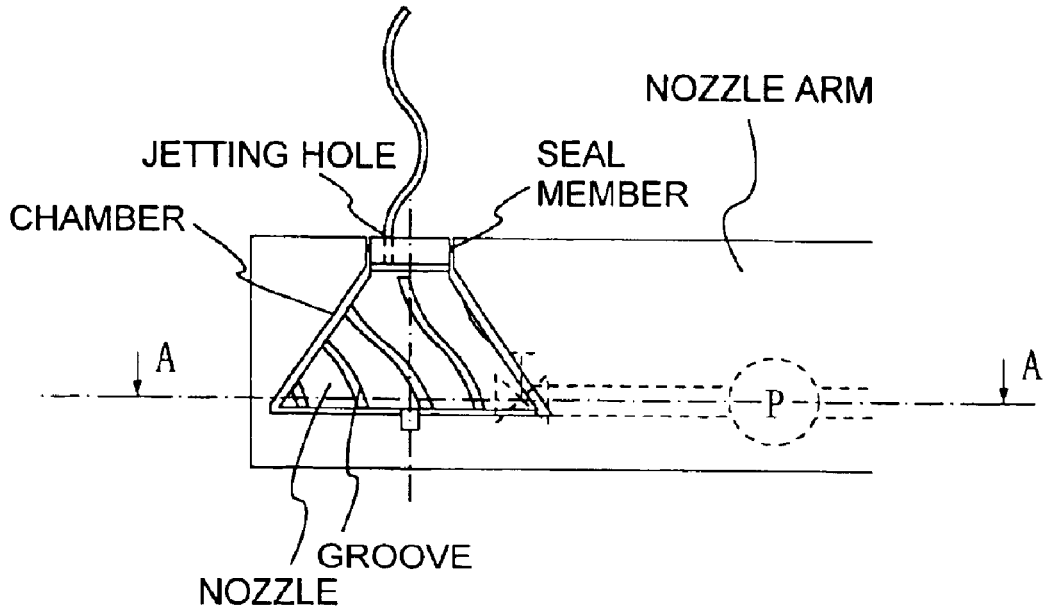
PRIOR ART Fig.1(a)
FIG. 1 is an explanatory diagram for explaining the structure conventionally adopted for rotatably driving a nozzle with cleansing water pressure.
Figure 1A:
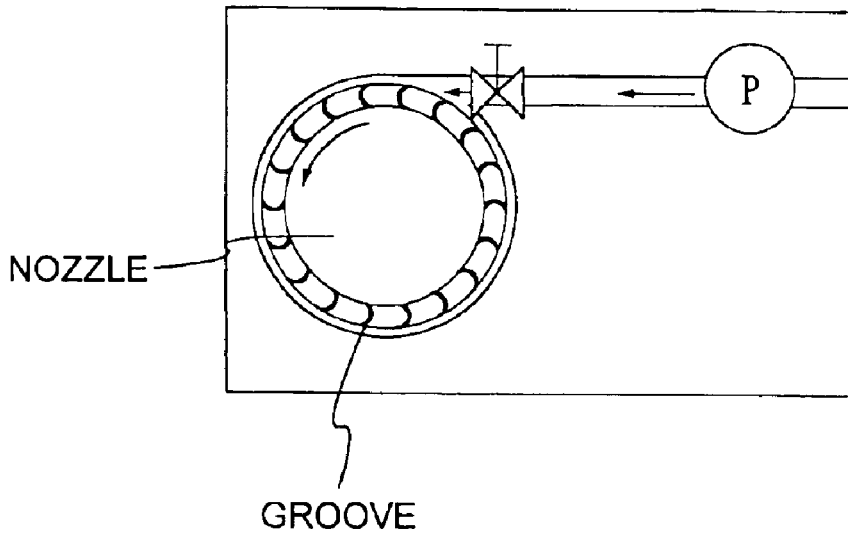
PRIOR ART Fig.1(a)
Figure 2:
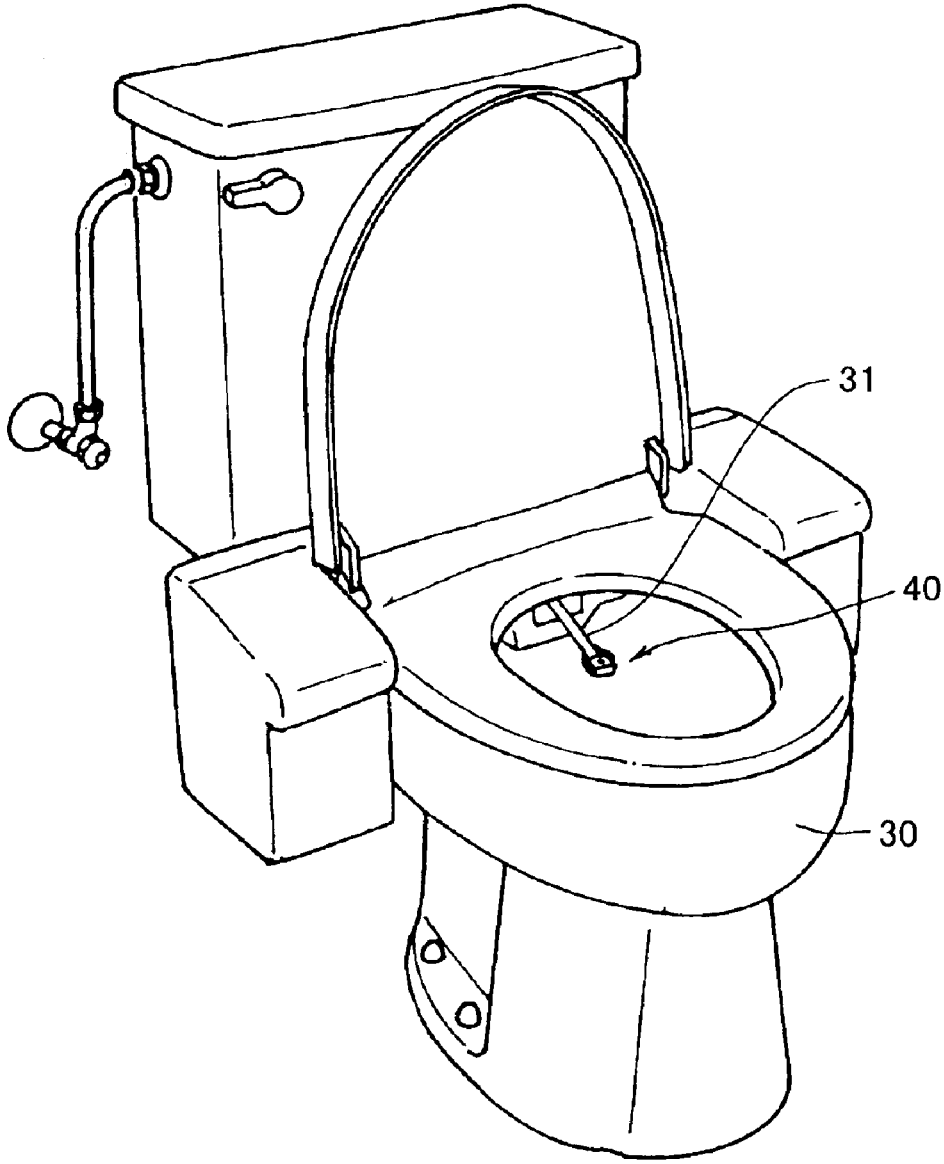
FIG. 2 is a schematic perspective view illustrating the appearance of a toilet bowl 30 having a cleansing water jetting device 40 of an embodiment employing the present invention.

Modes for carrying out the present invention are now explained based on the embodiments. FIG. 2 is a schematic perspective view illustrating the appearance of a toilet bowl 30 having a cleansing water jetting device 40 of an embodiment employing the present invention, FIG. 3 is an explanatory diagram showing the vertical schematic cross section of the cleansing water jetting device 40 of an embodiment and the enlargement of a relevant part thereof, and FIG. 4 is a horizontal schematic cross section of this cleansing water jetting device 40.

This cleansing water jetting device 40 is suitable for a human body part cleansing device which cleanses a part (anus for example) of the human body after defecation, and is build in a nozzle arm 31. The nozzle arm 31 can move forward and back freely against the toilet bowl, and, upon cleansing a part of the body, moves forward to the exemplified cleansing position and starts jetting cleansing water from the cleansing water jetting device 40. The cleansing water jetting device 40 comprises a chamber 2 for receiving the cleansing water, and jets the supplied cleansing water from a cleansing water jetting spout 5. This cleansing water jetting device 40 is described in detail below.

The cleansing water jetting device 40 comprises a hexahedron corner block 8, and a through hole penetrating and formed in the vertical direction of the center portion thereof is made to be the chamber 2. The chamber 2 is blocked off with an upper cover 9 and a lower cover 10, with an O ring 22 standing therebetween, at both the upper and lower ends thereof, and the respective covers are fixed to the corner block 8 with bolts not shown.

Figure 3:
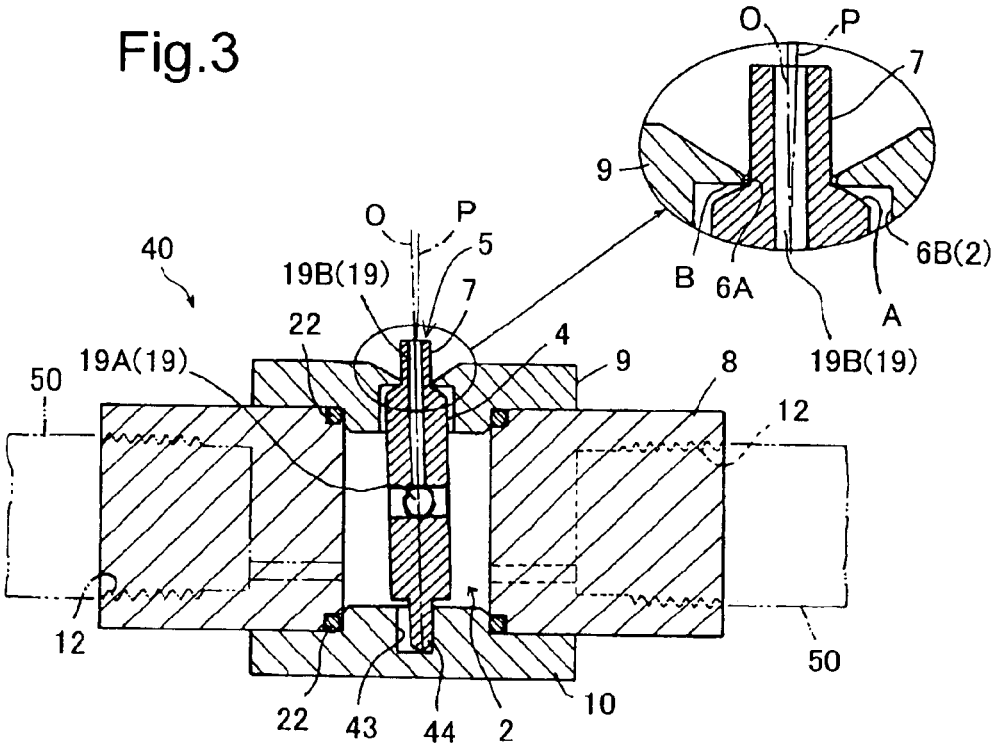
FIG. 3 is an explanatory diagram showing the vertical schematic cross section of the cleansing water jetting device 40 of an embodiment and the enlargement of a relevant part thereof.
Figure 4:
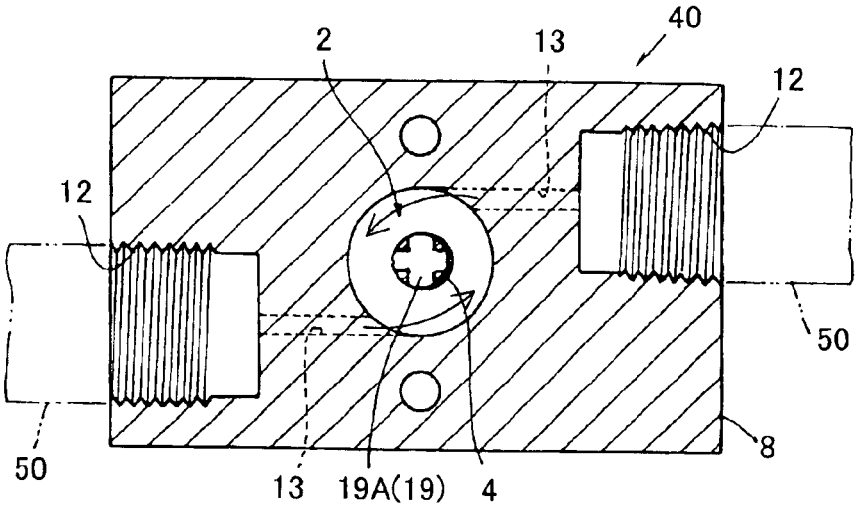
FIG. 4 is a horizontal schematic cross section of this cleansing water jetting device 40.

As shown in FIG. 3 and FIG. 4, the upper cover 9 comprises at its center an upper side through hole 6A of a small diameter and a lower side through hole 6B of a large diameter in continuation thereto, and the upper side through hole 6A is the ceiling opening of the chamber 2. This upper side through hole 6A has a depression at the outer periphery thereof, and the opening thereof is an edge shape in which the measurement toward the axial core decreases. The step portion B of the upper side through hole 6A and the lower side through hole 6B becomes the ceiling wall of the chamber 2, and receives the nozzle 4 describes later. The lower cover 10 comprises a concave portion 43 at the center of the convex portion thereof that functions as a receiver of the nozzle 4.

The corner block 8 has a bottomed female screw holes 12 on both sides in the longitudinal direction thereof, and a communicating hole 13 reaching the chamber 2 from the screw bottom face. A water supply hose 50 for supplying cleansing water is connected to this female screw hole 12, and the cleansing water is supplied to the chamber 2 from this hose with a pump not shown. Here, the female screw hole 12 is formed at an offset in the horizontal direction against the chamber 2, and the communicating hole 13 is formed so as to communicate with the chamber 2 at the outer wall thereof. Moreover, the communicating holes 13 at both ends of the block body adopt a positional relationship of being rotationally symmetrical. Thus, when cleansing water flows into the chamber 2 from both of these communicating holes, a vortical flow which circles in the arrow direction shown in FIG. 9 occurs at the chamber 2.

The nozzle 4 has a cleansing water jetting spout 5 at the nozzle tip side, and a conduit 19 for guiding the fluid supplied by the chamber 2 to this cleansing water jetting spout 5. Further, with the nozzle 4, the nozzle tip side and the bottom side are made to be a condensed diameter member 7 and a bottom portion 44, which respectively have a small diameter. The nozzle 4 having a condensed diameter member at the top and bottom thereof as described above inserts the condensed diameter member 7 into the upper side through hole 6A and places the bottom portion 44 into the concave portion 43 of a circular hole. Here, the nozzle 4 is incorporated in a state of being freely rotatable in the upper side through hole 6A and where the position change of the nozzle 4 in the O direction of the nozzle axial core is allowed. Here, an end face A of the nozzle portion having a diameter larger than the condensed diameter member 7 has a spherical shape as shown with the enlargement of the relevant portion in the diagram. Moreover, since the concave portion 43 is set to have a diameter that is roughly 1.3 times the diameter of the bottom portion 44, it functions as a guide of the nozzle upon the bottom portion 44 changing its position in the radial direction within the concave portion 43.

As a result of the radial direction position change guide function of the lower portion 44 with the concave portion 43 and the narrowing of the axial core direction measurement of the upper side through hole 6A having an edge-shaped opening, the nozzle 4 is able to adopt an inclined posture of approximately 1.78 degrees against the central axis P of the upper side through hole 6A. And, the nozzle 4 is able to revolve around the central axis P of the upper side through hole 6A in this inclined posture. In addition, the condition of this nozzle revolution will be described later in detail.

In this embodiment, the nozzle 4 forms the conduit 19 for guiding the cleansing water to the cleansing water jetting spout 5 with a conduit portion 19A and a conduit portion 19B. The conduit portion 19A is a cross-shaped horizontal conduit formed by penetrating through the vicinity of the center portion of the nozzle longitudinal direction so as to intersect with the nozzle axial core O. The conduit portion 19B is formed vertically along the nozzle axial core O, is in communication with the conduit portion 19A, and reaches the fluid jetting spout 5 on the tip side.

When the cleansing water is supplied to the chamber 2 with a pump, the chamber 2 becomes filled with the cleansing water that flows in by the force of pump pressure from a pair of communicating holes 13 in contact therewith. Thus, the nozzle 4, upon receiving the cleansing water pressure (pump pressure) from the cleansing water, changes its position (changes to an elevated position) toward the outer side (upper side) of the nozzle tip. Thereby, the end face A of the nozzle portion having a diameter larger than the condensed diameter member 7 contacts the lower side end face B (corresponds to the chamber ceiling wall on the opening side) of the upper side through hole 6A on the upper cover 9 side. Here, the bottom portion 44 of the nozzle 4 becomes a floating state in the cleansing water, and this bottom portion 44 receives the foregoing guide of the concave portion 43. In other words, the nozzle 4 is able to adopt the foregoing inclined posture.

Since the cleansing water is continuously supplied to the chamber 2, the cleansing water whirls around at the chamber 2 by the foregoing force of pump pressure as described above. Thus, the nozzle 4 rotates around the nozzle axial core O (rotates on its axis) by the force of cleansing water pressure (pump pressure) of the vortical flow of cleansing water. Here, since the nozzle 4 adopts an inclined posture against the central axis P of the upper side through hole 6A, this nozzle 4 rotates (revolves) round the central axis P of the upper side through hole A. In addition, the cleansing water of the chamber 2 arrives at the cleansing water jetting spout 5 by being guided with the horizontal conduit portion 19A and the vertical conduit portion 19B. Thus, the nozzle 4 jets cleansing water from the cleansing water jetting spout 5 while the nozzle rotates around the nozzle axial core O and revolves around the central axis P in an inclined posture.

Thereby, the cleansing water jetted from the cleansing water jetting spout 5 becomes a conical shape around the central axis P of the opening of the upper side through hole 6A in the chamber 2, and fluid can be jetted to a broad area. In other words, the nozzle 4 jets the cleansing water on a virtual conical peripheral face with the extending portion of the central axis P of the upper side through hole 6A as the central axis, and cleansing water can thereby be jetted to a broad area.

Further, as described above, pursuant to its own elevated positional change, the nozzle 4 seeks to seal both end faces by making the end face A of the nozzle portion having a diameter larger than the condensed diameter member 7 contact the lower side end face B of the upper side through hole 6A.

In this kind of sealed state, although slight, since there is space for fluid to infiltrate between the chamber ceiling wall and the end face of the nozzle portion, this infiltrated fluid will function as a lubricant. Thus, since the resistance subjected by the end face A of the nozzle portion from the lower side end face B of the upper side through hole 6A can be decreased, a favorable sealing effect is enabled even when the fluid pressure within the chamber 2 is low, and a favorable nozzle rotation (revolution) is yielded thereby. In other words, the cleansing water pressure within the chamber 2, and ultimately the pump pressure can be kept low.

With respect to the cleansing water jetting device 40 having the foregoing structure, a jetting test was conducted with the cleansing water pressure within the chamber 2 at approximately 0.01 MPa. Even with this kind of low pressure water supply, according to the cleansing water jetting device 40 of the present embodiment, it has been demonstrated that the nozzle 4 could be operated without hindrance to jet the cleansing water in the foregoing conical shape. Thus, according to the cleansing water jetting device 40 of the present embodiment, since the supply pressure of the cleansing water to the chamber 2 can be kept low, the actuator of a pump or the like for supplying the cleansing water can be miniaturized and the operating cost can be reduced for such portion. In addition, even if the fluid pressure of the supplied fluid is low as in the foregoing case, high rotation could be maintained without having to considerably reduce the speed of rotation (revolution) of the nozzle 4 and the cleansing water jetting spout 5 thereof. As a result, even if it is of a low pressure water supply, cleansing water can be jetted conically in a stable manner, and this will not invite the narrowing of the cleansing area.

Further, in this embodiment, upon the nozzle adopting the inclined posture, since the bottom portion 44 is guided with the concave portion 43, the nozzle inclination posture during the nozzle revolution around the central axis P of the opening can be stabilized. Thus, this stabilizes the condition of the jetted cleansing water, and such jetted cleansing water accurately contacts and cleanses the portion to be cleansed.

In the foregoing case, the nozzle inclination posture can be easily set to a desired posture by variously adjusting the measurement relationship of the bottom portion 44 and the concave portion 43. Thus, the broadening and narrowing of the water contact area (cleansing area) of the jetting target (cleansing portion) of the jetted cleansing water can be adjusted thereby.

Moreover, with the cleansing water jetting device 40 of the present embodiment, upon seeking the contact between the end faces as described above, the end face A of the nozzle portion having a diameter larger than the condensed diameter member 7 is made to have a spherical shape. Thus, the rotational resistance placed on the rotating and revolving nozzle 4 from the end face B on the chamber 2 side can be made small. As a result, the rotation and revolution efficiency of the nozzle 4 increases, compatibility with low water supply pressure increases, and it is thereby possible to further seek the miniaturization of the actuator and reduction of operating costs.

Further, since the end face A of the nozzle portion having a diameter larger than the condensed diameter member 7 is formed in a spherical shape, this is further effective in the stabilization of the point contact and prevention of wear accompanying the contact between the end face A and end face B. Particularly, in a case where the nozzle 4 is revolving in an inclined posture, since the gap portion other than the point contact portion of the foregoing both end faces around the upper side through hole 6A can be narrowed, the cleansing water leaking through this gap portion can be reduced. Thereby, the cleansing water can be effectively used for the jetting from the cleansing water jetting spout 5.

In the foregoing embodiment, the nozzle 4 is formed of a material superior in wear resistance; for example, resin such as polyacetal, nylon, polypropylene, polytetrafluoroethylene, silicone, ABS, and PPS; or metal such as stainless steel. Thus, wear entailing the contact between the foregoing end faces and the contact between the bottom portion 44 and the inner wall of the concave portion 43 can be suppressed with certainty. In particular, if the nozzle 4 is made of metal, the heat release efficiency of the abrasive heat arising from these contacts can be increased. As a result, melting and fixation by the heat of abrasion can be avoided, and the reliability of nozzle revolution and ultimately the fluid jetting can be increased. Further, if the nozzle 4 is formed of the foregoing metal material, the nozzle weight can be increased for such portion. As a result, the inertia exhibited by the nozzle increases, the centrifugal force during the nozzle revolution increases, and this is preferable in that the stabilization of the nozzle inclination posture during such revolution can be sought thereby. When forming the nozzle 4 from metal such as stainless steel, it is even more preferable if the surface roughness is made small. In addition, it is possible to form the nozzle 4 such that the portion subject to wear is formed of metal, and the other portions are formed of resin. This type nozzle 4 can be easily manufactured with a so-called two-color molding method of metal and resin.

Figure 5:
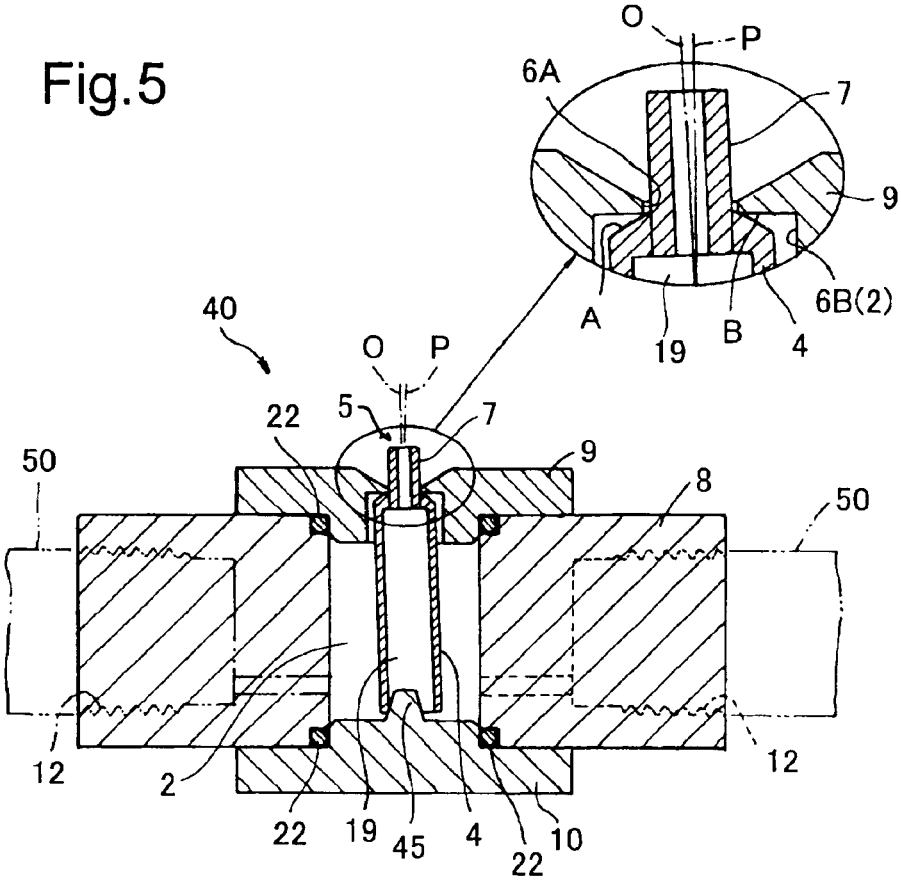
FIG. 5 is an explanatory diagram showing the vertical schematic cross section of the cleansing water jetting device 40 of a modified example and the enlargement of a relevant part thereof.
Figure 6:
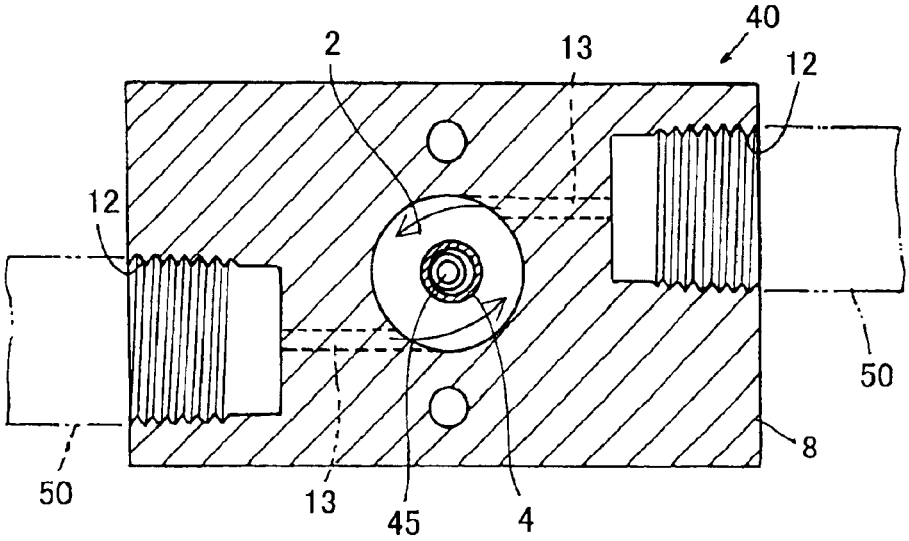
FIG. 6 is a horizontal schematic cross section of this cleansing water jetting device 40 of the modified example.

Next, a modified example of the foregoing embodiment is explained. In this modified example, the nozzle structure differs from the foregoing embodiment. FIG. 5 is an explanatory diagram showing the vertical schematic cross section of the cleansing water jetting device 40 of the modified example and the enlargement of a relevant part thereof, and FIG. 6 is a horizontal schematic cross section of this cleansing water jetting device 40 of the modified example.

The nozzle 4 in this modified example is formed to be hollow, and such hollow portion is made to be the conduit 19 leading to the cleansing water jetting spout 5. This conduit 19 is formed to have a condensed diameter at the cleansing water jetting spout 5 side of the nozzle tip side, and guides the cleansing water flowing in from the conduit bottom to the cleansing water jetting spout 5 after rectifying such cleansing water at the condensed diameter conduit portion. In addition, a structure can be adopted where a plurality of horizontal through holes is formed on the peripheral wall of the nozzle 4 so as to enable the conduit 19 to also supply the cleansing water from the outer side of the radial direction.

With this nozzle 4, a convex member 45 having a truncated cone shape on the tip (upper end) side of the lower cover 10 is placed inside the lower end side opening. Since the convex member 45 is set to have its maximum diameter to be approximately 1/1.3 times the bottom side opening of the nozzle 4, it contacts the bottom side opening in a state where the convex member 45 is placed inside the bottom side opening, and functions as a guide upon the nozzle 4 changing its position toward the radial direction.

Moreover, the point of making the upper side through hole 6A, which is the ceiling opening of the chamber 2, to have an edge-shaped opening in which the measurement decreases in the axial core direction thereof, and the point of making the end face A of the nozzle portion having a diameter larger than the condensed portion 7 of the nozzle 4 to have a spherical shape are the same as the other embodiment described above.

In this embodiment as well, as a result of the radial direction position guide function of the nozzle 4 with the convex member 45 and the narrowing of the axial core direction measurement of the upper side through hole 6A having an edge-shaped opening, the nozzle 4 is able to adopt an inclined posture of approximately 1.78 degrees against the central axis P of the upper side through hole 6A. And, the nozzle 4 is able to revolve around the central axis P in this inclined posture.

Even in this embodiment, as a result of the supply of cleansing water to the chamber 2, the nozzle 4 changes its position to an elevated position, and the end face A having a diameter larger than the condensed diameter member 7 contacts the lower side end face B (corresponds to the chamber ceiling wall on the opening side) of the upper side through hole 6A on the upper cover 9 side. Here, the bottom end side of the nozzle 4 becomes a floating state in the cleansing water, and the nozzle 4 adopts the foregoing inclined posture upon receiving the guide of the convex member 45 via the nozzle bottom side opening.

And, by adopting this kind of contact state, the nozzle 4 jets cleansing water from the cleansing water jetting spout 5 while rotating around the nozzle axial core O and revolving around the central axis P of the upper side through hole 6A in an inclined posture.

Thereby, even with this modified example, the cleansing water jetted from the cleansing water jetting spout 5 becomes a conical shape around the central axis P of the opening of the upper side through hole 6A in the chamber 2, and fluid can be jetted to a broad area. In other words, the nozzle 4 jets the cleansing water on a virtual conical peripheral face with the extending portion of the central axis P of the upper side through hole 6A as the central axis, and cleansing water can thereby be jetted to a broad area.

Further, in this modified example, since the conduit 19 is made to penetrate in the axial center direction of the nozzle, weight saving of the nozzle can be sought. Thus, the inertia exhibited by the nozzle itself decreases and the inclined posture and nozzle revolution by the force of fluid pressure can be realized more easily, and the startability and rotational frequency thereof can be improved.

Moreover, since the contact state of the nozzle side end face A and the chamber side end face B is the same as the other embodiment described above, effects accompanying the reduction in resistance between the two faces; for instance, effects can be yielded in the miniaturization of the actuator of a pump or the like for supplying fluid to the chamber, and the reduction of operating costs as described above.

Figure 7:
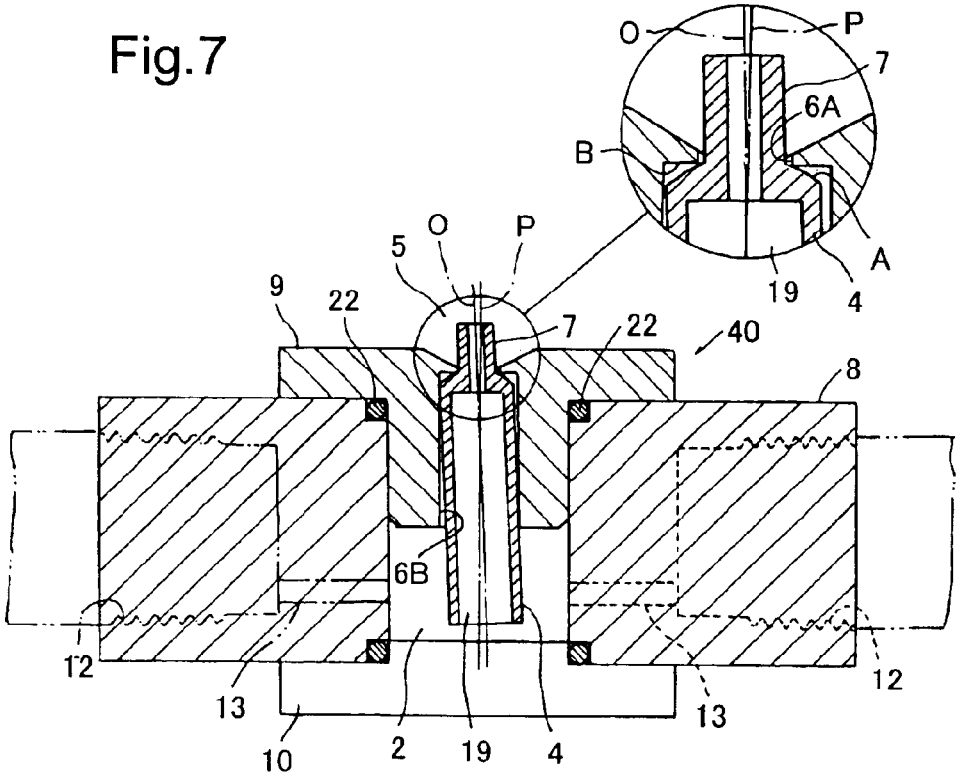
FIG. 7 is an explanatory diagram showing the vertical schematic cross section of the cleansing water jetting device 40 of another modified example and the enlargement of a relevant part thereof.
Figure 8:
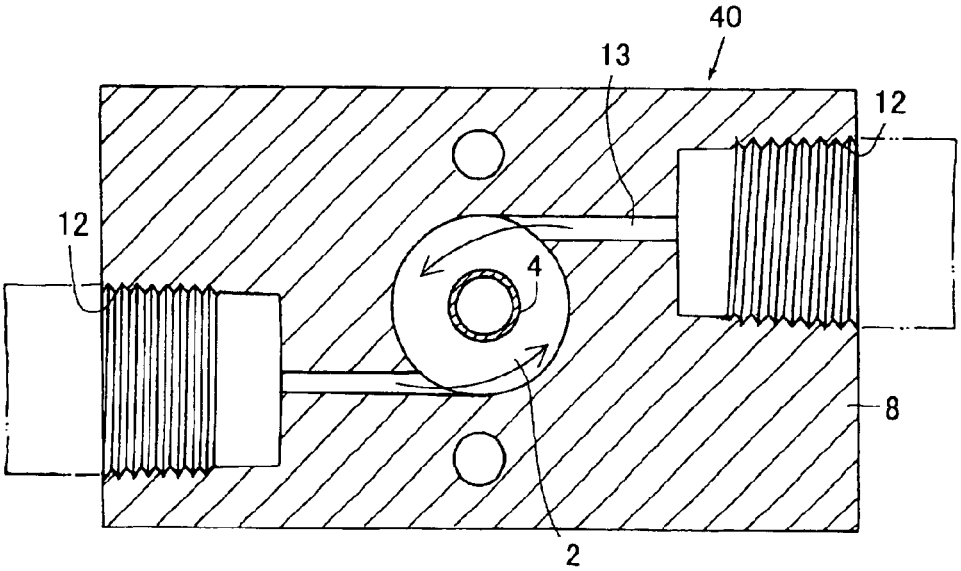
FIG. 8 is a horizontal schematic cross section of this cleansing water jetting device 40 of the modified example.

Another modified example of the foregoing embodiment is now explained. In this different embodiment, the condition of retaining the nozzle inclination posture differs from the foregoing modified example. FIG. 7 is an explanatory diagram showing the vertical schematic cross section of the cleansing water jetting device 40 of another modified example and the enlargement of a relevant part thereof, and FIG. 8 is a horizontal schematic cross section of this cleansing water jetting device 40 of the modified example.

As illustrated in the diagrams, with this modified example, the structure differs from the foregoing modified example in that the lower cover 10 does not have the foregoing convex member 45 at the tip (upper end) side thereof, and the upper cover 9 extends inside the chamber 2 while the lower side through hole 6B is made to be a deep hole.

In this modified example, upon the nozzle 4 adopting the inclined posture and revolving around the central axis P of the upper side through hole 6A, it makes contact with the foregoing end faces A, B, and the peripheral wall of the lower side through hole 6B of the upper cover 9 guides the nozzle by contacting the nozzle 4.

This modified example is also capable of yielding the same effects as the foregoing modified example.

In the embodiment and modified examples described above, upon supplying cleansing water to the chamber 2, a pair of communicating holes 13 was symmetrically provided to the corner block 8. Nevertheless, a structure may also be adopted where only one communicating hole 13 is formed such that the cleansing water is supplied to the chamber 2 from only a single water supply hose 50.

Further, the lower side end face B of the upper side through hole 6A can be formed in a spherical shape. Furthermore, the lower side end face B of the upper side through hole 6A and the end face A of the nozzle portion having a diameter larger than the condensed diameter member 7 may both be formed in a spherical shape.

Figure 9:
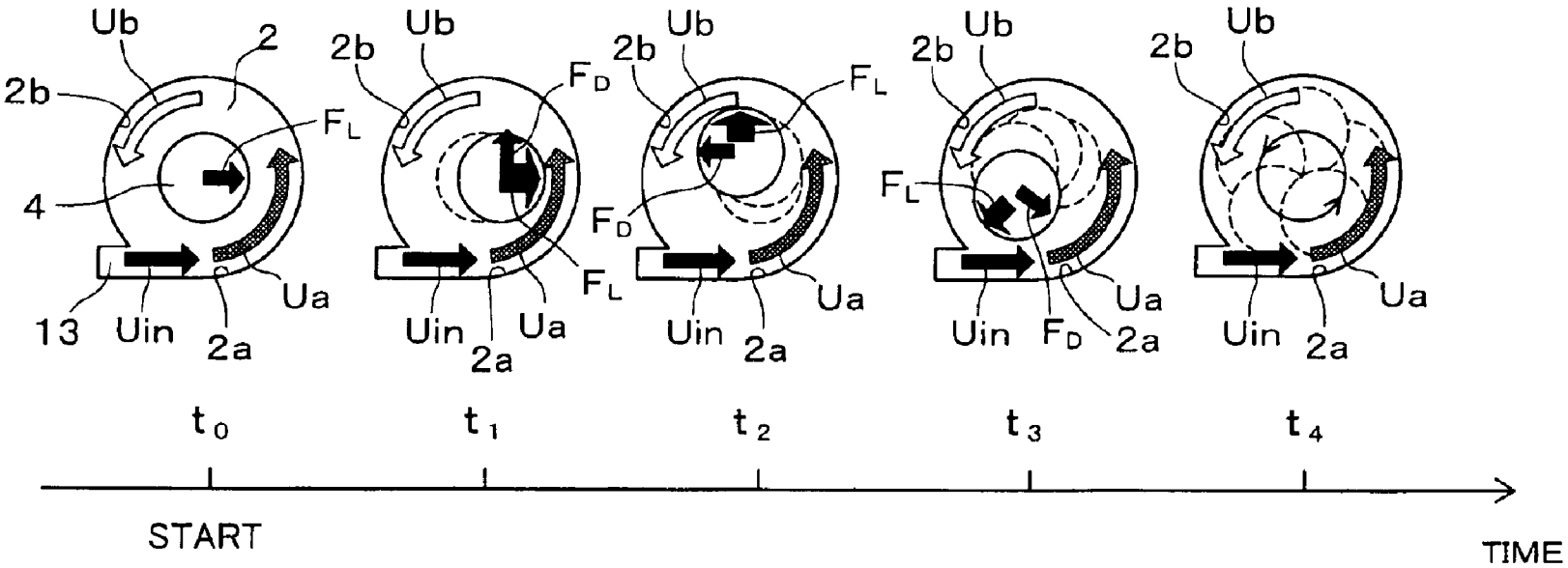
FIG. 9 is an explanatory diagram for explaining the behavior of a nozzle 4 after the cleansing water flows into a chamber 2 and the condition of the power applied to this nozzle 4 in parallel with the lapse in time.
Figure 10:
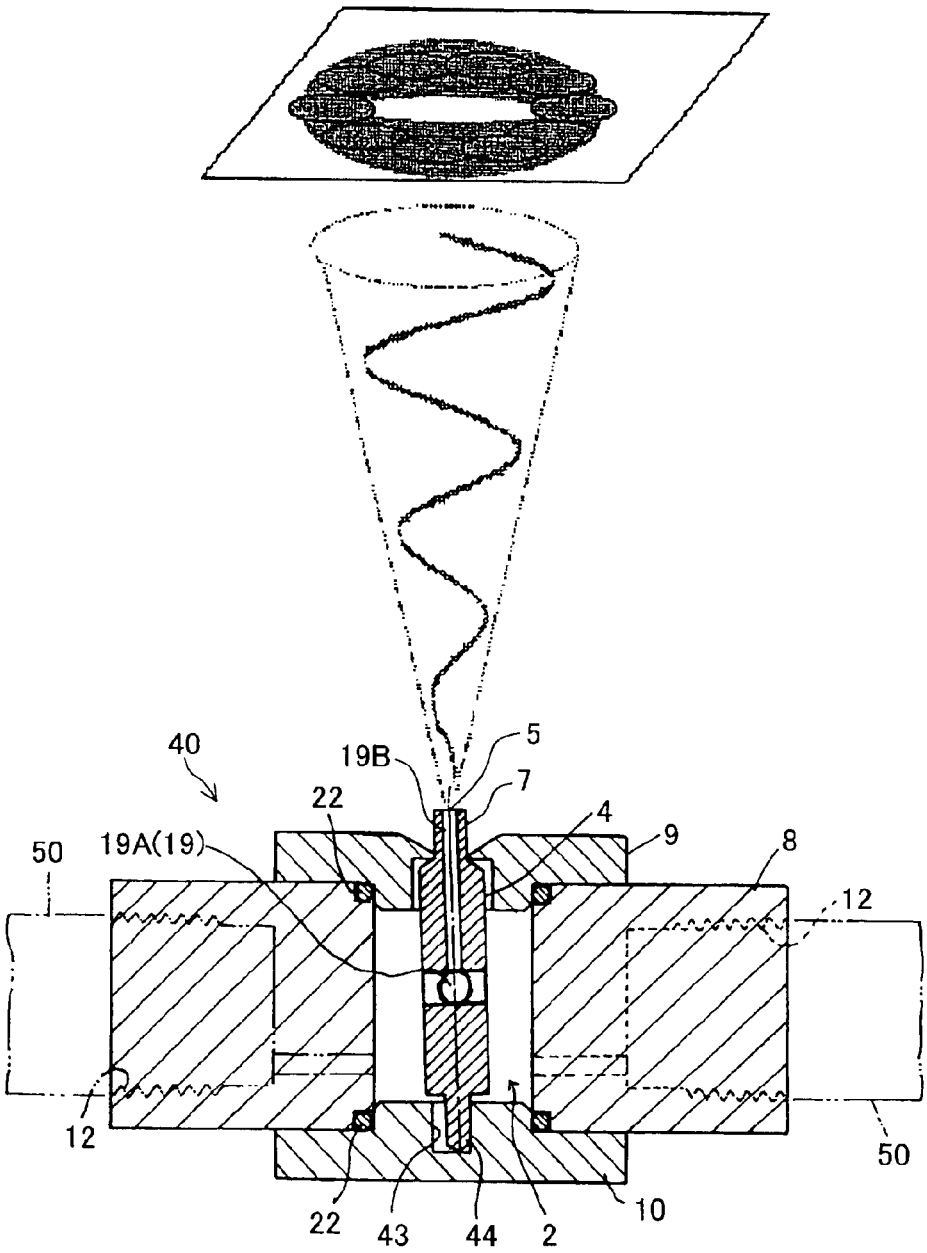
FIG. 10 is an explanatory diagram for explaining the cleansing water jetting condition obtained as a result of the nozzle 4 adopting the behavior illustrated in FIG. 9.

Here, the condition of the nozzle 4 within the chamber 2 in the embodiment and modified examples illustrated in FIGS. 3 to 8 revolving around the central axis P of the upper side through hole 6A by the force of cleansing water supply is described in detail. FIG. 9 is an explanatory diagram for explaining the behavior of the nozzle 4 after the cleansing water flows into the chamber 2 and the condition of the power applied to this nozzle 4 in parallel with the lapse in time, and FIG. 10 is an explanatory diagram for explaining the cleansing water jetting condition obtained as a result of the nozzle 4 adopting such behavior. In addition, for the sake of simplifying the description, explanation will be made regarding a case of supplying cleansing water to the chamber 2 from a single communicating hole 13.

As depicted in FIG. 9, cleansing water is now starting to flow into the chamber 2 from the communicating hole 13 (time t0). When the cleansing water flows into the chamber 2 in this manner, the cleansing water generates a vortical flow along the inner wall inside the chamber 2 as described above. This vortical flow becomes a whirl that circles around the nozzle 4 (specifically, the nozzle portion having a large diameter of the nozzle 4) positioned in the approximate center of the chamber 2. Regarding the flow velocity of this vortical flow, the flow velocity Uin at the communicating portion of the communicating hole 13 is of the fastest rate.

With the place where the cleansing water initially begins to circle; that is, a peripheral wall portion 2*a* as an extension of the opening of the communicating hole 13, and a peripheral wall portion 2*b* opposing such portion, a difference arises in their respective flow velocity Ua and flow velocity Ub, and the relationship between the two becomes Ua>Ub. In other words, while the cleansing water circulates (circles around) from the peripheral wall portion 2*a* to the peripheral wall portion 2*b*, the cleansing water decelerates due to the flow dispersion within the chamber 2, contact of the chamber 2 inner wall face and the cleansing water, cleansing water viscosity, surface friction and so on. Thus, a flow velocity difference occurs around the nozzle 4. In such a case, although the moving object will be a fluid (cleansing water), the relative relationship of the cleansing water and the nozzle 4 is not differ from a state of an object moving through the fluid.

Therefore, upon a physical object moving through the fluid, the condition of lift acting on such the physical object based on a flow velocity differential of the fluid with the physical object therebetween occurs between the cleansing water and the nozzle 4 within the chamber 2, and force homogenous with the lift acts on the nozzle 4. This lift acts as one mode of the cleansing water pressure applied to the nozzle 4 by the cleansing water flowing into the chamber 2 as described in the foregoing embodiment and the like. In addition, for the sake of convenience, this force is referred to as the lift as described above, but, if this is to be exemplified in another phenomenon, the lift generated from the velocity differential of the fluid is the same as the lift generated from the velocity differential, or the pressure difference, of the wing surface of an aircraft.

As illustrated in FIG. 9; at time t0 where the nozzle 4 enters the chamber 2, the following situation occurs. The vortical flow around the nozzle 4 stopped at time t0 will occur, and the lift $F_L$ thereof will be affected by the flow velocity Ua [m/sec] of the vortical flow of the peripheral wall portion 2*a*. Then, the lift $F_L$ can be represented with the following formula when the maximum projective area of the nozzle 4 subject to lifting power is represented as S [$m^2$], and the density of cleansing water is represented as p [$kg/m^3$]. CL in the formula represents the lift coefficient.

$$FL=(p\cdot V2\cdot CL\cdot S)/2[N]$$

When the lift FL acts on the nozzle 4 as described above, as a result, the drag FD (=(p·V2·CD·S)/2[N]) will also act on the nozzle 4. This CD is a drag coefficient. This drag also works as one mode of the cleansing water pressure applied to the nozzle 4 from the cleansing water flowing to the chamber as described in the foregoing embodiment and the like.

The maximum projective area S in the foregoing formula depends on the length L [m] of the nozzle 4 (specifically, on the large diameter nozzle portion positioned within the chamber 2). Thus, if the length L of the nozzle 4 is made longer, the lift and drag can be increased.

As shown at time t0 in FIG. 9, when a vortical flow occurs around the nozzle 4 in the chamber 2, as described above, lift will act on the nozzle 4. This lift acts from the center to the outside of the vortical flow on the peripheral wall portion 2*a* side in which the flow velocity of the vortical flow is large around the nozzle 4. Meanwhile, since the nozzle 4 is revolvable around the central axis P of the upper side through hole 6A in an inclined posture in the chamber 2, the nozzle 4 receives the lift $F_L$ and incline toward the direction shown with the arrow $F_L$ in the diagram. When the nozzle 4 inclines toward the inner wall side of the chamber 2, at time t1, this lift $F_L$ and drag $F_D$ both act and move toward the resultant force direction thereof. Since this resultant force is force along the flow direction of the vortical flow, it acts to move the nozzle 4 along the flow direction of the vortical flow.

As a result, the passage interval of the vortical flow at the side to which the nozzle 4 is inclined becomes narrow, and the vortical flow velocity increases with such narrowing. Since this situation occurs with the narrowed interval portion moving around the nozzle 4, the portion where the vortical flow is of the largest flow velocity also moves along the inner peripheral wall of the chamber 2. Therefore, pursuant to the movement of the portion having the largest flow velocity, the lift $F_L$ direction and the drag $F_D$ direction also change, and, in connection with the progress of time as in time t2, t3, t4, the nozzle 4 moves in the flow direction of the vortical flow while maintaining its inclined posture. Moreover, once the nozzle 4 receives lift and drag in this manner and begins to revolve, centrifugal force acts on the nozzle 4 in the radial direction of the chamber 2. This centrifugal force also works as one mode of the cleansing water pressure applied to the nozzle 4 from the cleansing water flowing to the chamber 2 as described in the foregoing embodiment and the like.

Thus, the nozzle 4 adopts the inclined posture in a state where the both end faces are in contact, and revolves in the chamber 2 around the central axis P of the upper side through hole 6A. Since the nozzle 4 revolves in this manner, as described above, it is able to jet the cleansing water on the virtual conical peripheral face with the extending portion of the central axis P of the upper side through hole 6A as the central axis, and cleansing water can thereby be jetted to a broad area.

Further, during such jetting of the cleansing water in a conical shape, the foregoing maximum inclination angle of the nozzle 4 is restricted with either the concave portion 43, convex member 45 or lower side through hole 6B, and, therefore, the nozzle 4 will not revolve at an improperly large inclination.

In addition, when the nozzle 4 is affected by the lift FL and inclines toward the inner wall side of the chamber 2 as described above, this nozzle 4 will be subject to the drag FD in a direction to be pushed directly by the vortical flow of the chamber 2. Thus, the nozzle 4 having an inclined posture will also be subject to the foregoing centrifugal force and will further move in the flow direction of the vortical flow while maintaining its inclined posture, and the revolution of the nozzle 4 will be facilitated thereby.

Here, the appearance of this type of revolving jetting water is now explained with reference to the drawings. As shown in FIG. 10, when the nozzle revolves as described above, the cleansing water jetting spout 5 revolves while changing the jetting direction pursuant to the revolution of the nozzle 4. Thus, the cleansing water jetting spout 5 jets the cleansing water while depicting a path of an expanding spiral shape, and, as a result thereof, jetting of the conical-shaped cleansing water described above can be realized. Therefore, the jetting path of cleansing water can be made to be a conical path that is much larger than the path of the cleansing water jetting spout 5, and body parts can be cleansed in a broad area.

In addition, upon performing this kind of broad-area cleansing, a vortical flow is generated by flowing cleansing water into the chamber 2, and it suffices to make the nozzle 4 revolve as described above with such vortical flow. That is, upon performing broad-area cleansing, the only required movable member is the small nozzle 4 that is built in the chamber 2 provided to the nozzle arm 3.

Moreover, broad-area cleansing with the jetting of such conical-shaped cleansing water can be easily realized by incorporating the nozzle 4 in to the chamber 2, and generating a vortical flow upon introducing the cleansing water to the chamber 2. This will enable a simplified structure, reduction in costs, and, through such simplified structure, the miniaturization of the device can also be sought.

Further, the communicating hole 13 for flowing cleansing water into the chamber 2 is made to have a smaller cross-sectional flow area in comparison to the water supply hose 50 in order to increase the flow velocity of the cleansing water flowing to the chamber 2. The flow velocity of cleansing water flowing into the chamber 2 prescribes the lift $F_L$ as described above. Thus, by preparing communicating holes 13 having a variety of cross-sectional flow areas (specifically, the corner blocks 8 having communicating holes 13 of various diameters) and selectively using the same, the lift $F_L$ as well as the drag and centrifugal force acting on the nozzle 4 can be adjusted. These forces set forth the frequency of the foregoing nozzle 4 revolution. Thus, the revolution frequency of the nozzle 4 can also be adjusted through the adjustment of the cross-sectional flow area of the communicating hole 13 or through the selection of the corner block 8. This yields the following advantages.

When the force and area at the moment cleansing water contacts the object to be washed such as the human body are respectively represented as F1, ΔS, the intensity of cleansing water instantaneously felt by the human body can be prescribed as F1/ΔS. When the swivel revolution frequency of the nozzle 4 is represented as f1 and jetting is continued at this frequency, the total area S, which corresponds to the object to be washed such as the human body, becomes a value of ($S=\int \Delta S$) obtained by integrating ΔS during the cycle Δt in time intervals of cycle (Δt=1/f1), which is a reciprocal of the frequency f1.

Meanwhile, when a person is feeling stimulation with one's skin or the like, the sense organ feeling such stimulation will embrace the illusion of receiving continuous stimulation or stimulation similar to such a feeling against stimulation in a range of several Hz to several hundred Hz; although this will vary depending on the person or the place such stimulation is felt. Therefore, when stimulation of intensity F1/ΔS is moved (total movement path $S=\int \Delta S$) at a certain instant along a path at a cycle of Δt, a person will embrace an illusion of receiving stimulation of intensity F1/ΔS at the total area S. This tendency is more prominent when Δt is smaller, and stimulation will be felt from f=roughly 3 Hz; that is, Δt=approximately 0.3 seconds.

Therefore, by adjusting the cross-sectional flow area of the communicating area 13 or selecting the corner block 8, the revolution frequency f1 of the nozzle 4 can be made to be approximately 3 Hz or more. With this, the cleansing area is increased without having to diminish (reduce) the stimulation of cleansing.

Further, the relationship of the force F1 (hereinafter referred to as force F1) and the cleansing water amount Q1 to be jetted at the foregoing certain instant can be represented with the following formula when the jetting spout area is represented as S1 and the flow velocity of cleansing water is represented as V1.

$$F1=p\cdot Q\cdot V1=p\cdot Q2\cdot Q/S1$$

As evident from this formula, the force F1 is proportionate to the square of instantaneous flow volume Q, and is in reverse proportion to the jetting spout area S1. Thus, when decreasing the flow volume through water conservation, the force F1 can be increased as a result of decreasing the area S1 of the cleansing water jetting spout 5. Therefore, in order to improve or maintain the stimulation or cleansing power during the cleansing while reducing the amount of water, it is evident that the jetting spout area S1 must be reduced; that is, the flow velocity of the cleansing water to be jetted must be increased.

Further, the revolution frequency f1 of the nozzle 4 may be made approximately 40 Hz or more by adjusting the cross-sectional flow area of the communicating hole 13 or selecting the corner block 8. With this, the nozzle can revolve at a high speed, and the cleansing point to where the jetted cleansing water is to make contact can be moved at a high speed. Thus, the human body will embrace an illusion as though one's body is being subject to water contact in the entire water contact area (collective area of water contact point) of the spouted water. As a result, when the frequency is adjusted as described above, this is preferable in that the demand of a soft and broad-area cleansing can be realized through the illusion yielded with the high-speed movement of the water contact point. Specifically, stimulation can be favorably alleviated while performing spout water cleansing to a broad area in a cleansing device specifically designed for a female body part that is sensitive to stimulation, or in the bidet cleansing of a standard local cleansing device.

Moreover, since the foregoing illusion will be embraced even when the water contact is changing to the cleansing point in a practical sense, continuous jetting of water as though the cleansing water is simultaneously contacting the entire water contact area will not be required. Thus, a water conservation effect is yielded for such portion.

Figure 11A:
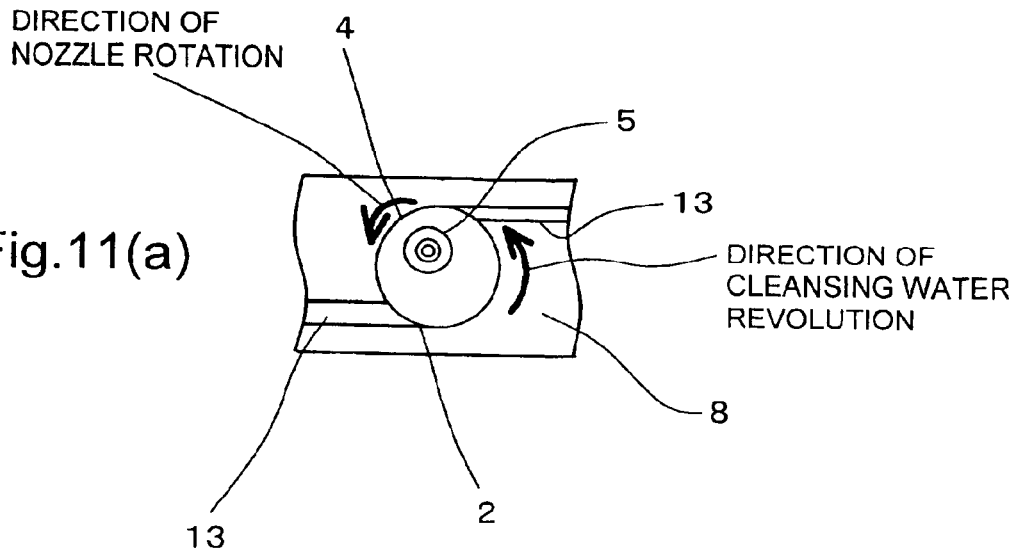
FIG. 11 is an explanatory diagram for explaining the relationship of the rotation and revolution of the nozzle 4, wherein FIG. 11(*a*) is an explanatory diagram showing a case where the rotation and revolution of the nozzle 4 have the same rotative direction, and FIG. 11(*b*) is an explanatory diagram showing a case where the rotation and revolution of the nozzle 4 have the opposite rotative direction.
Figure 11B:
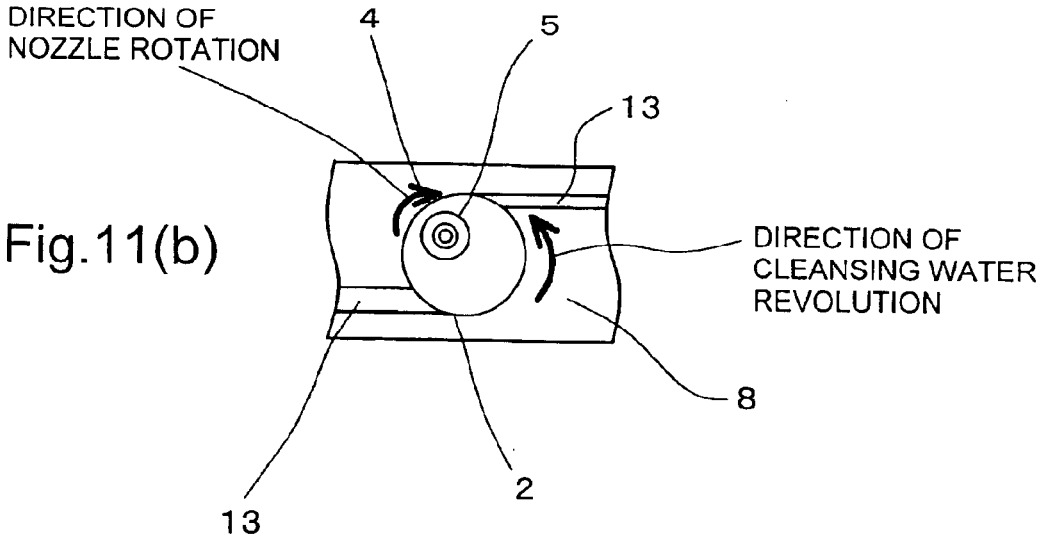
Figure 12A:
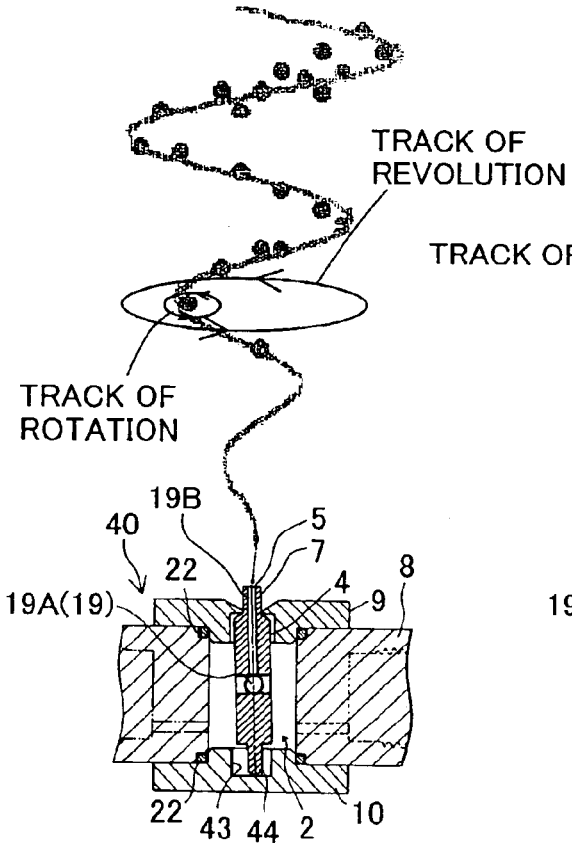
FIG. 12 is an explanatory diagram for explaining the cleansing water jetting condition obtained as a result of the nozzle 4 adopting the behavior illustrated in FIG. 11, wherein FIG. 12(*a*) is an explanatory diagram for explaining the cleansing water jetting condition in a case where the nozzle rotation and revolution are of the same rotative direction, and FIG. 12(*b*) is an explanatory diagram for explaining the cleansing water jetting condition in a case where the nozzle rotation and revolution are of the opposite rotative direction.
Figure 12B:
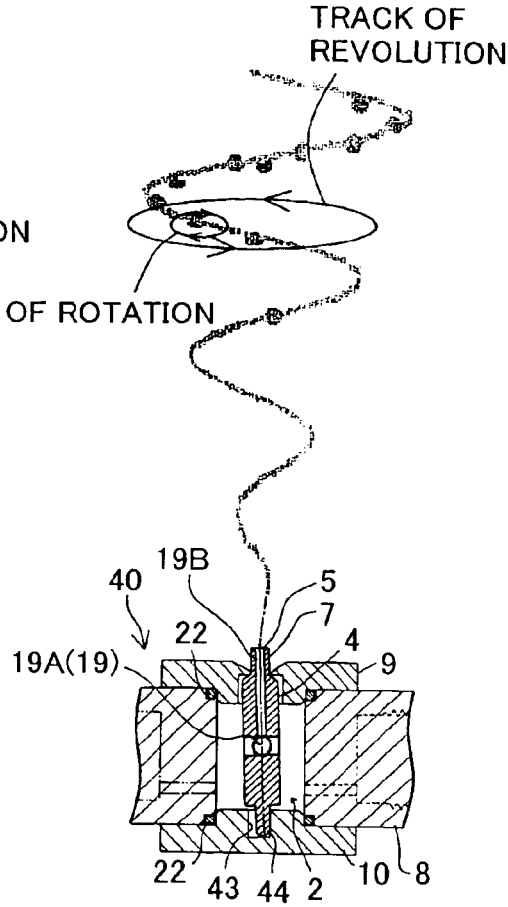

Next, the appearance of the nozzle 4 in the chamber 2 of the embodiment and modified examples illustrated in FIGS. 3 to 10 rotating around the nozzle axial core O (rotating on its axis) by the force of supplied cleansing water is explained in detail. FIG. 11 is an explanatory diagram for explaining the relationship of the rotation and revolution of the nozzle 4, wherein FIG. 11(*a*) is an explanatory diagram showing a case where the rotation and revolution of the nozzle 4 have the same rotative direction, and FIG. 11(*b*) is an explanatory diagram showing a case where the rotation and revolution of the nozzle 4 have the opposite rotative direction. FIG. 12 is an explanatory diagram for explaining the cleansing water jetting condition obtained as a result of the nozzle 4 adopting the behavior illustrated in FIG. 11, wherein FIG. 12(*a*) is an explanatory diagram for explaining the cleansing water jetting condition in a case where the nozzle rotation and revolution are of the same direction, and FIG. 12(*b*) is an explanatory diagram for explaining the cleansing water jetting condition in a case where the nozzle rotation and revolution are of the opposite direction.

The nozzle 4 revolves in the same direction as with the vortical flow direction depicted in FIG. 11 by the foregoing vortical flow in the chamber 2. During this nozzle revolution, at the foregoing contact portions (end faces A, B) of the nozzle 4, only a slight slipping resistance operates due to the lubricating function of the infiltrated cleansing water as described above. Thus, in a state where only such contacts are made (for instance, a state where the bottom portion 44 does not contact the concave portion 43 in FIG. 8, or a structure yielding such contact), the force (revolving force) trying to revolve the nozzle 4 with the lift based on the vortical flow resists the slight slipping resistance and endeavor to make the nozzle 4 rotate on its axis. As a result, the nozzle 4 rotates on its axis in the same direction as the spiral direction (revolving direction) of the cleansing water, and revolves within the spiral chamber.

Thus, the nozzle 4 generating this kind of revolution and rotation in the same direction jets cleansing water in the path illustrated as a frame format in FIG. 12(*a*). This FIG. 12(*a*) is for explaining with arrows, in an easy to understand manner, the rotational path direction by the cleansing water rotation at the cleansing water jetting spout 5, and the movement path of the cleansing water by the nozzle revolution in an arbitrary plane perpendicular to the jetting direction. In other words, the cleansing water is jetted while rotating in the counterclockwise direction by the rotation of the nozzle 4, and this kind of jetting revolves in the counterclockwise direction by the revolution of the nozzle 4. Therefore, at the outer periphery of the revolution track of this cleansing water, the rotational direction and revolution direction of the cleansing water coincide, and, therefore, the cleansing water is subject to a large air resistance produced with the total of the cleansing water rotation speed and the cleansing water revolution speed at the outer periphery of such revolution track. Pursuant to this air resistance, the cleansing water generates turbulence from the massed flow with time and become dispersed upon being ripped down into droplets. Thus, since the cleansing water jetted from the nozzle 4 under this condition contacts the human body in a dispersed droplet state upon advancing along the revolution track, a broad area can be washed with even more softness.

Meanwhile, with the nozzle 4 illustrated in FIG. 8, FIG. 10 and FIG. 12, during the nozzle revolution, it contacts the inner wall of the concave portion 43, the outer wall of the convex member 45 or the inner wall of the chamber 2 in addition to the foregoing end faces. In this state, since the slipping resistance against the nozzle 4 revolution increases in comparison to the foregoing condition, there can be certain cases where the nozzle 4 cannot be made to rotate on its axis in the same direction as the revolving direction with the foregoing revolving force. Even in such a case, the nozzle 4 revolves with the revolving force, and the nozzle 4 rotates on its axis while contacting the inner wall of the concave portion 43, the outer wall of the convex member 45 or the inner wall of the chamber 2 upon being subject to the slipping resistance at the foregoing contact portions. In this case, the rotational direction is determined with the received portion where the nozzle 4 receives the slipping resistance. That is, in the case of the outer wall of the convex member 45 shown in FIG. 10, the rotational direction becomes the same as the revolving direction of the nozzle 4, and the nozzle 4 jets cleansing water while revolving and rotating in the same direction. Meanwhile, in the case of the inner wall of the concave portion 43 or the inner wall of the chamber 2 shown in FIG. 8 and FIG. 12, the nozzle 4 jets cleansing water while revolving, and rotating in the reverse direction thereof. In addition, when the rotation direction and revolving direction of the nozzle are the same, the rotational energy of the jetted cleansing water works on the nozzle revolution, and it is therefore possible to conduct the nozzle revolution more efficiently.

The nozzle 4, which is conducting the foregoing reverse revolution and rotation, jets cleansing water in a track shown as a frame format in FIG. 12(*b*). In other words, the cleansing water is jetted while rotating in the clockwise direction by the rotation of the nozzle 4, and this kind of jetting revolves in the counterclockwise direction by the revolution of the nozzle 4. Therefore, at the outer periphery of the revolution track of this cleansing water, the rotational direction and revolution direction of the cleansing water is opposite, and, therefore, the cleansing water is subject to a small air resistance produced with the difference of the cleansing water rotation speed and cleansing water revolution speed at the outer periphery of such revolution track. Pursuant to this kind of small air resistance, the cleansing water is not dispersed as much and be jetted while maintaining a relatively massed water flow status. Thus, since the cleansing water jetted from the nozzle 4 under this condition contacts the human body while maintaining a relatively massed water flow status, intense cleansing with further stimulation can be conducted. Moreover, it is also possible to perform cleansing with less scattering since the jetted water will be massed.

As depicted in FIG. 11, if the communicating holes 13 are made to have different diameters, the flow velocity of the cleansing water flowing into the chamber 2 can be differed. Thus, the foregoing velocity differential can be created easily, and this is effective in the generation of the lift or the like based on the vortical flow in the chamber 2. Needless to say, the communicating holes 13 may have the same diameter.

Figure 13:
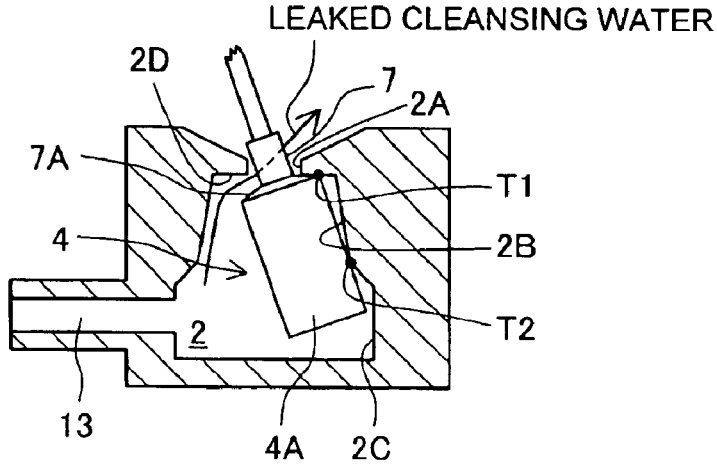
FIG. 13 is an explanatory diagram for explaining the first method upon the nozzle 4 taking an inclined posture.

Next, the point of making the nozzle 4 adopt an inclined posture against the central axis of the opening of the chamber 2 is described in detail. FIG. 13 is an explanatory diagram for explaining the first method upon the nozzle 4 taking an inclined posture.

As illustrated in the diagram, in order to adopt this first method, the chamber 2 comprises a ceiling opening 2A at the ceiling wall thereof, and has a tapered wall-shaped guide hole portion 2B and a bottom hole portion 2C at the lower part thereof. The ceiling opening 2A is an opening corresponding to the upper side through hole 6A in the cleansing water jetting device 40 illustrated in FIG. 8 and the like, and is an edge-shaped opening having a small measurement in the axial core direction.

The cleansing water flowing from the communicating hole 13 into the chamber 2 becomes a vortical flow in the chamber 2 from the bottom hole portion 2C as described above, thereby yielding the foregoing revolution of the nozzle 4. The nozzle 4 adopts an inclined posture by the foregoing lift and the like entailing the nozzle revolution. Here, the nozzle 4 makes the condensed diameter member 7 and the large diameter member 4A and the step end face 7A (end face A in the foregoing embodiment) contact the ceiling wall 2D of the chamber 2. In addition to realizing the contact at such condensed diameter member 7 side, the nozzle 4 also makes the peripheral wall of the large diameter member 4A contact the lower end edge portion of the guide hole portion 2B. That is, the nozzle 4 makes contact with the two exemplified contact portions; namely, T1 and T2, and the posture thereof is stabilized since the inclined posture is prescribed at both of these contact portions.

In addition, since these contact portions T1, T2 are separated to the ceiling wall 2D and the lower end edge portion of the guide hole portion 2B on the chamber wall side, it is achieved to stabilize further the inclined posture. Moreover, since the contact portions are separated as described above, even if the ceiling opening 2A is made to have a small diameter, the appearance and reproducibility of the nozzle inclination posture is not affected. In addition, when the ceiling opening is made to have a small diameter, the gap portion around the ceiling opening also becomes small, and, while securing the lubricating function of the fluid leaking through the gap portion, the amount of this leaking fluid can be reduced.

And, the nozzle 4 jets the cleansing water while revolving around the central axis of the ceiling opening 2A in the inclined posture as prescribed above. The appearance of this jetted cleansing water is as per the explanation of FIG. 15. In addition, the nozzle 4 described in FIG. 8 has the same prescribed inclined posture of this first method, and the contact at end faces A, B corresponds to the contact at contact portion T1, and the contact of the concave portion 43 and convex portion 44 corresponds to the contact portion T2. The nozzle 4 explained in FIG. 10 also adopts this first method, and the contact at end faces A, B corresponds to the contact at contact portion T1, and the contact of the convex member 45 and the lower end side opening of the nozzle corresponds to the contact at contact portion T2.

Therefore, even when the nozzle inclination posture is prescribed with this first method, the cleansing water jetted from the nozzle 4 is of a conical shape around the central axis of the ceiling opening 2A in the chamber 2, and fluid can be jetted to a broad area.

And, when the nozzle is revolving while adopting this inclined posture, leakage of the leaked cleansing water exhibits the lubricating function as illustrated in the diagram. Thus, as described above, since the resistance placed on the nozzle 4 from the ceiling 2D of the chamber 2 can be reduced, it is possible to further seek the miniaturization of the actuator and reduction of operating costs. In addition, since the rotation of the nozzle can be maintained at a high rotation even if the cleansing water supply pressure is low, this will not invite the narrowing of the cleansing area.

Further, with this first method, the rotational resistance at the contact portion T1 of the ceiling wall 2D is small due to the lubrication effect of the leaked cleansing water, and, even at the contact portion T2, only a small rotational resistance operates since it is a point contact. Nevertheless, since the nozzle 4 is free within the chamber, such rotational resistance acts as frictional resistance against the nozzle 4, as described in FIG. 12, the nozzle 4 rotates on its own central axis. Thus, the contact portion T1 of the nozzle 4 against the ceiling wall 2D changes around the rotating axis by the rotation of the nozzle, and this does not invite a case where a specific location is always contacting the ceiling wall 2D. Thus, the wear of the nozzle 4 can be suppressed with certainty.

Moreover, since the condensed diameter member 7 of the nozzle tip is inserted and disposed inside the ceiling opening 2A, the cleansing water leaking through the gap portion around the ceiling opening 2A does not interfere with the jetted cleansing water. Thus, since turbulence does not occur to the jetted cleansing water having a conical shape, it is thereby possible to seek the stabilization of the jetted cleansing water.

Figure 14:
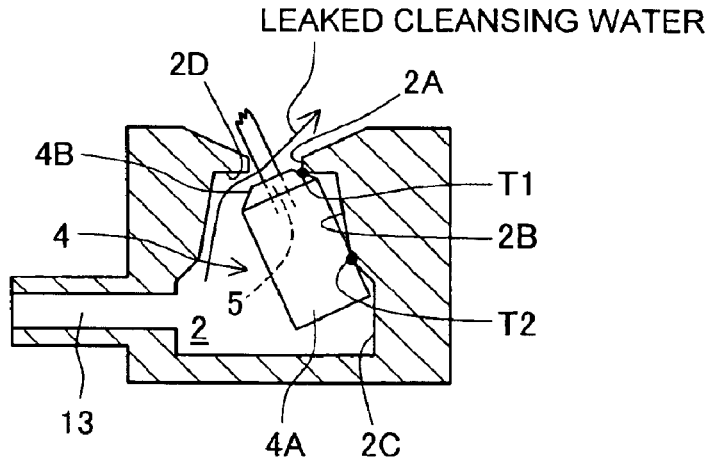
FIG. 14 is an explanatory diagram for explaining another mode upon adopting the first method for prescribing the nozzle inclined posture.

This kind of first method can also be realized as follows. FIG. 14 is an explanatory diagram for explaining another mode upon adopting the first method for prescribing the nozzle inclined posture, and FIG. 15 is an explanatory diagram for explaining still another mode of the first method.

As illustrated in the diagrams, in these modes, the nozzle 4 is not provided with a condensed diameter member 7, and is only structured from a large diameter member 4A. Even with this nozzle 4, the tip portion 4B of the large diameter member 4A is made to contact, in place of the foregoing step end face 7A, the ceiling wall 2D at the contact portion T1, and the other end is made to contact the contact portion T2. FIG. 14 shows a case where the tip portion 4B is of a tapered shape and FIG. 15 shows a case of a spherical shape.

In these modes, although the nozzle 4 is not protruding outside the chamber since it is entirely incorporated inside the chamber 2, there is no difference in that the cleansing water jetting spout 5 is protruded outside the ceiling opening 2A of the chamber 2.

Figure 15:
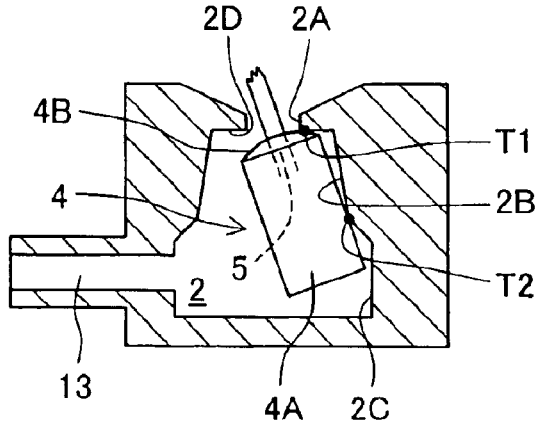
FIG. 15 is an explanatory diagram for explaining still another mode of the first method.

The modes illustrated in FIG. 14 and FIG. 15 also yield the same effects as those described above with the nozzle having a condensed diameter member 7. In particular, the following advantages are exhibited with these modes.

Since it is not necessary to insert and dispose the condensed diameter member 7 inside the ceiling opening 2A, the ceiling opening 2A can be miniaturized for such portion. Thus, since the gap portion around the ceiling opening 2A also becomes smaller, the amount of cleansing water leaking through can be reduced while securing the lubricating function by the leaked cleansing water.

Further, since the nozzle does not protrude outside the chamber 2, the nozzle does not contact the cleansing portion even when the chamber 2 is close to the cleansing portion. Thus, it is possible to prevent a situation where the nozzle revolution is stopped from the outside, and hindrance to the jetting of cleansing water can be prevented thereby.

In addition, the ceiling opening 2A can be miniaturized to a degree of not contacting the spouted water, and the diameter of the movement path of the contact portion T1 can also be miniaturized. Thus, the area subject to water pressure within the chamber becomes narrow, and the nozzle rotation can be maintained even when the water supply pressure of the cleansing water is low.

Figure 16:
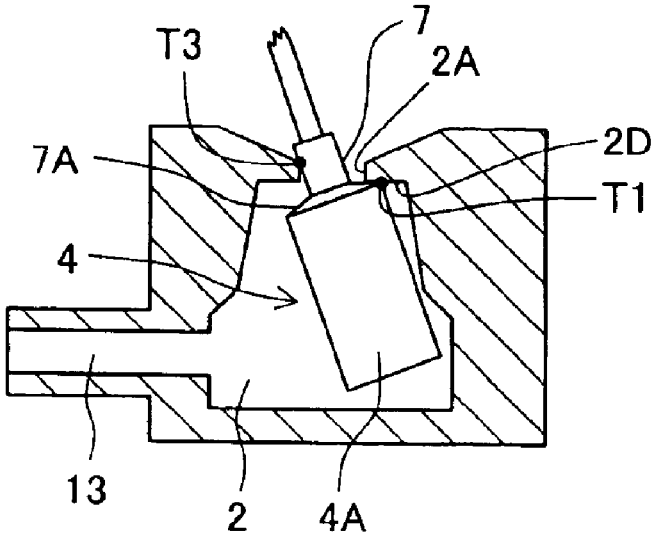
FIG. 16 is an explanatory diagram for explaining the second method upon the nozzle 4 taking an inclined posture.
Figure 17:
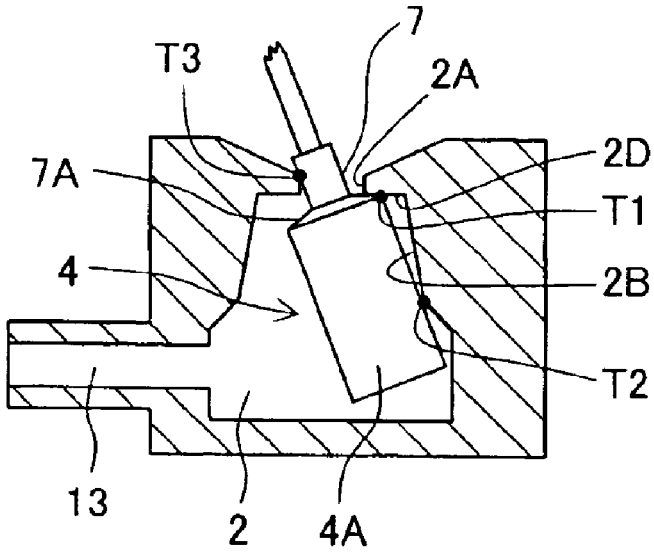
FIG. 17 is an explanatory diagram for explaining the third method upon the nozzle 4 taking an inclined posture.

FIG. 16 is an explanatory diagram for explaining the second method upon the nozzle 4 taking an inclined posture, and FIG. 17 is an explanatory diagram for explaining the third method upon the nozzle 4 taking an inclined posture.

As shown in FIG. 16, with the second method, in addition to the contact with the step end face 7A of at the contact portion T1, the nozzle 4 makes the outer periphery of the condensed diameter member 7 contact the opening wall of the ceiling opening 2A at the contact portion T3. Even with this structure, the nozzle inclination posture is prescribed with the two contact portions, and the posture is stabilized.

In the mode illustrated in FIG. 16, in addition to yielding the foregoing effects by inserting and disposing the condensed diameter member 7 inside the ceiling opening 2A, the following advantages are also exhibited.

As described above, the nozzle inclination posture is realized at the contact portion T3 of the ceiling opening 2A and the contact portion T1 of the ceiling wall 2D, and both of these contact portions are positioned with the ceiling opening 2A therebetween. Thus, by adjusting the diameter of the ceiling opening 2A, it is possible to separate or bring close the two contact portions, and to adjust the nozzle inclination posture. As the ceiling opening 2A can be easily post-processed from the outside, the nozzle inclination posture can be easily adjusted. In particular, when the ceiling opening 2A and the guide hole portion 2B are formed as the upper cover 9 as shown in FIG. 8, the nozzle inclination position can be easily adjusted by changing the upper cover 9 having a variety of opening diameters and guide hole portion shapes.

Moreover, since contact is made at the condensed diameter member 7 having a small diameter of the nozzle tip, the peripheral velocity of the nozzle rotation can be slowed down for the portion that the contact portion diameter is made small. Thus, even if the same portions make contact due the incomplete nozzle rotation, wear of the contact portion T3 around the opening can be suppressed since the peripheral velocity is slow. In addition, wear of the contact portion T3 around the opening can be suppressed even more effectively by the lubrication effect yielded by the leaked cleansing water.

With the mode illustrated in FIG. 17, in addition to the foregoing contact portions T1 and T3, the nozzle 4 also makes contact with the lower end edge portion of the guide hole portion 2B at the contact portion T2. Thus, in this mode, since the inclined posture is prescribed with three locations, the inclined posture can be secured even more stably. In addition, since the number of contact portions increases upon adopting the inclined posture, even in a case where the cleansing water supply pressure to the chamber 2 is of a high water supply pressure, the nozzle inclination posture can be maintained with even more certainty, and it is thereby possible to jet cleansing water in a conical shape in a stable manner, as well as to jet cleansing water accurately to a desired location.

Figure 18:
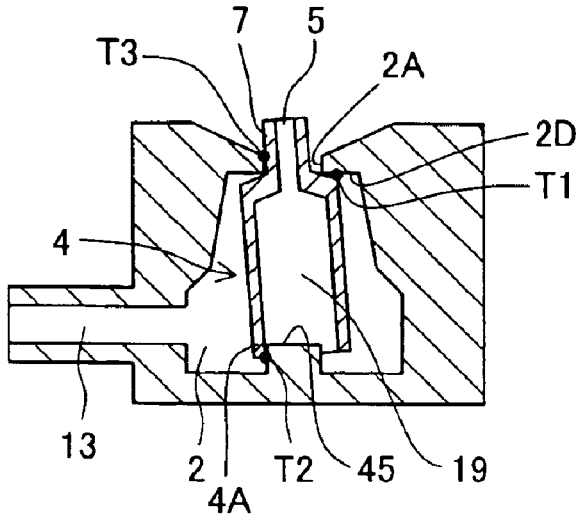
FIG. 18 is an explanatory diagram for explaining another method upon the nozzle 4 taking an inclined posture.

A modified method of adopting the foregoing inclined posture is now explained. FIG. 18 is an explanatory diagram for explaining another method upon the nozzle 4 taking an inclined posture, and FIG. 19 is an explanatory diagram for explaining a modified example of this method.

As depicted in FIG. 18, the nozzle 4 makes the contact portion T2 a contact of the nozzle lower end opening and the convex member 45 upon seeking the contacts of foregoing contact portions T1 to T3. Even with this structure, it is still possible to seek the stabilization of the nozzle inclined posture, and to further yield the foregoing advantages. Moreover, as shown in FIG. 19, it is also possible to provide a bottomed hole 4D to the lower end of the nozzle and to make the contact portion T2 a contact of such bottomed hole 4D and the convex member 45. In such a case, the conduit 19 is formed to be vertical and horizontal conduit portions 19A, 19B.

Figure 19:
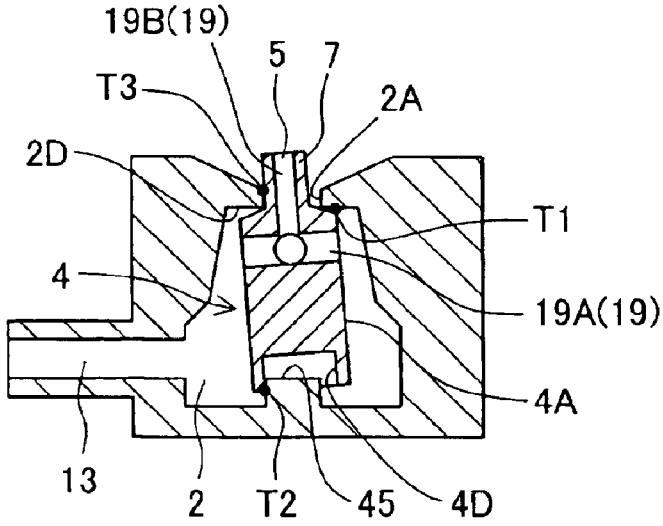
FIG. 19 is an explanatory diagram for explaining a modified example of this method.

Further, with the method shown in FIG. 18 and FIG. 19, the following structure may also be adopted. In other words, the nozzle 4 can make contact at two locations; namely, contact portion T1 of the ceiling wall 2D and contact portion T2 of the convex member 45 so as to prescribe the nozzle inclination posture at such contact portions.

Figure 20:
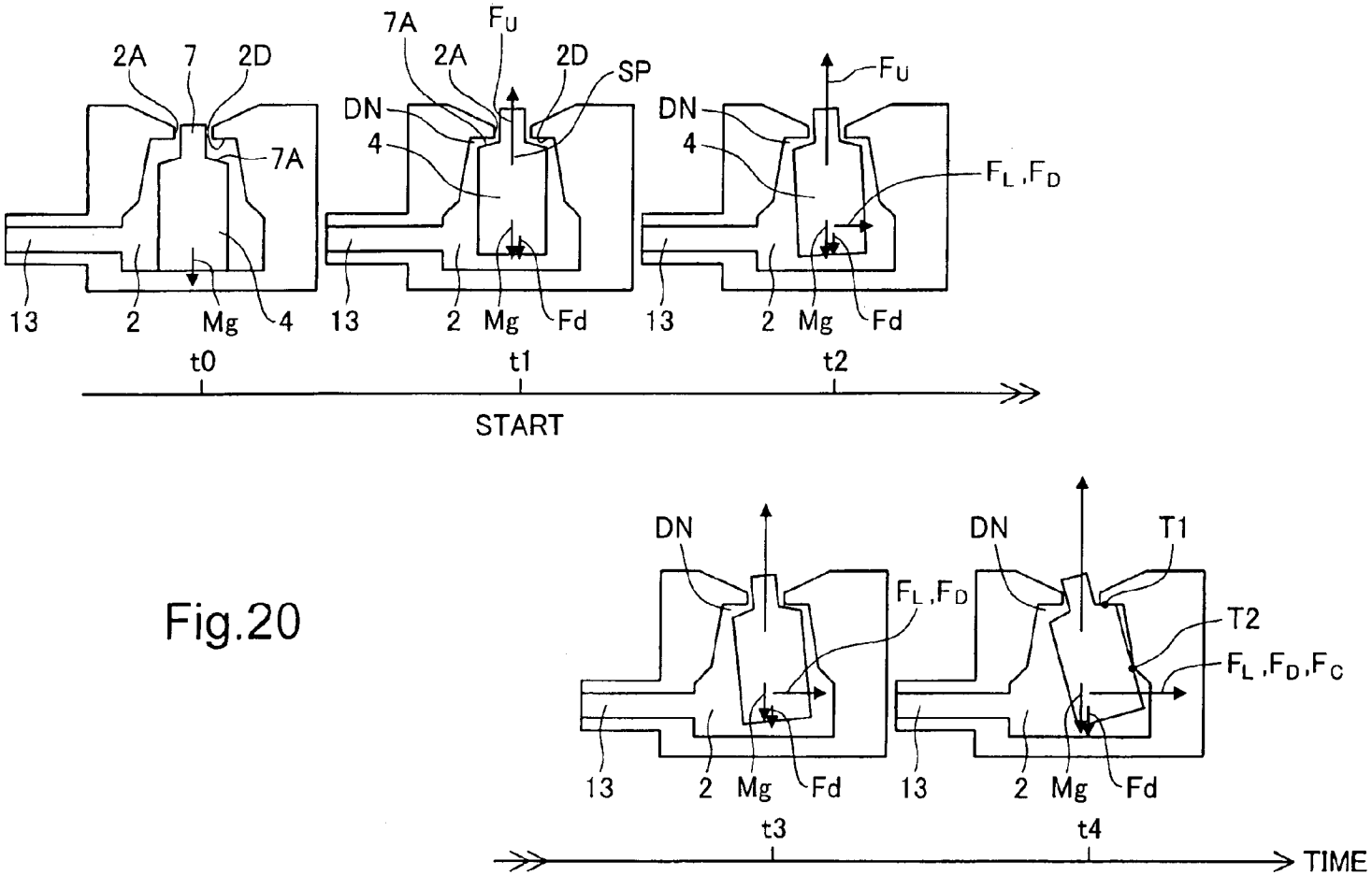
FIG. 20 is an explanatory diagram for explaining the condition in which the nozzle 4 is subject to elevated positional displacement pursuant to the supply of cleansing water.

The point of the nozzle 4 making the foregoing elevated positional change upon prescribing the nozzle inclination posture with the methods illustrated in FIGS. 13 to 19 is now explained. FIG. 20 is an explanatory diagram for explaining the condition in which the nozzle 4 is subject to elevated positional displacement pursuant to the supply of cleansing water.

As illustrated in the diagram, at time t0 prior to the water supply, the nozzle 4 is at the bottom of the chamber 2 due to its deadweight Mg. Here, when the supply of cleansing water is commenced at time t1, the chamber 2 is filled with the cleansing water supplied by the water supply pressure P1. The nozzle 4 begins to elevate receiving this water supply pressure P1 as the upthrust force FU. Simultaneously with this supply of cleansing water (time t2), a vortical flow occurs in the chamber 2 as described above, and the nozzle 4 thereby begins to incline upon being subject to the lift FL and drag FD based on this vortical flow.

In addition, in this kind of water supply state, the nozzle 4 is subject to the reactive force Fd from the jetted cleansing water, but since the upthrust force FU based on the water supply pressure prevails, there is no hindrance. Further, although cleansing water leaks from the gap DN between the step end face 7A of the nozzle 4 and the ceiling wall 2D, this cleansing water yields the lubrication effect upon the nozzle revolution to be commenced thereafter.

Since the amount of cleansing water to be supplied increases together with the lapse in time until reaching a set flow volume, during such time, the lift FL and drag FD increase pursuant to such increase in flow volume. Thus, the nozzle inclines even further (time t3). As this inclination and the elevation of the nozzle occur simultaneously, the nozzle 4 elevates until eventually being restricted by the ceiling wall 2D, adopt an inclined posture prescribed by contact portions T1, T2 (time t4), and revolve in this inclined posture in a stable manner. Further, since the nozzle 4 begins revolving upon being subject to the lift FL and drag FD after the foregoing time t1, centrifugal force acts on the nozzle inclination. Thus, the nozzle 4 inclines immediately.

As described above, the nozzle is subject to forces (lift FL, drag FD, centrifugal force) yielding the inclination and revolution of the nozzle in a free state prior to the elevation thereof being restricted at the ceiling wall 2D. Thus, since these forces transmits to and work on the nozzle 4 even more effectively, the nozzle inclination posture and nozzle revolution can be realized more easily, and the startability of revolution in an inclined posture can be improved. Further, the startability can be further improved with the lubrication effect by the cleansing water in the gap DN from the initial stages of water supply.

Moreover, with the nozzle in which the step end face 7A is in contact with the ceiling wall 2D, since it adopts the nozzle inclination in such a state, loss arises for transmittance of the forces (lift FL, drag FD, centrifugal force) yielding the nozzle inclination and revolution. Thus, in such a case, although the startability is inferior to the foregoing nozzle makes an elevated positional change, there is no particular hindrance in the practical application thereof.

Figure 21A:
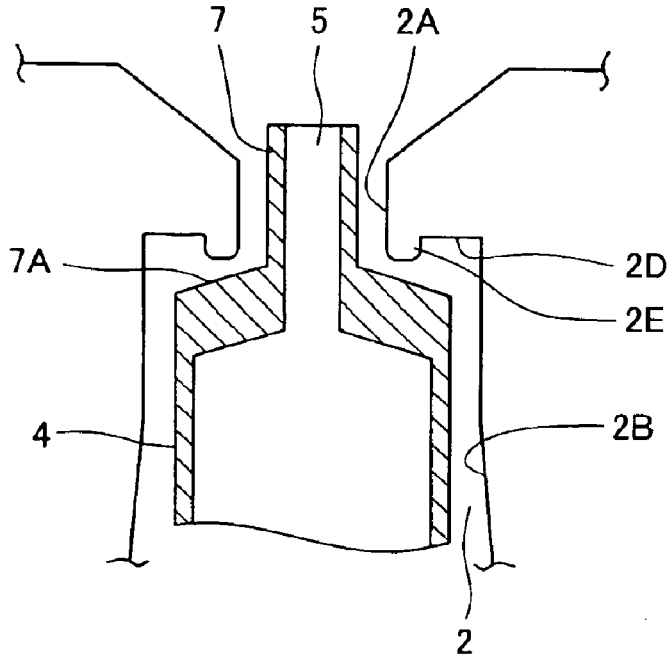
FIG. 21 is an explanatory diagram showing an enlargement of a relevant portion for explaining a modified example of the contact state of the ceiling wall 2D of the chamber 2 and the step end face 7A of the nozzle 4, wherein FIG. 21(*a*) shows the nozzle in a motionless state, and FIG. 21(*b*) shows the nozzle in an inclined state.
Figure 21B:
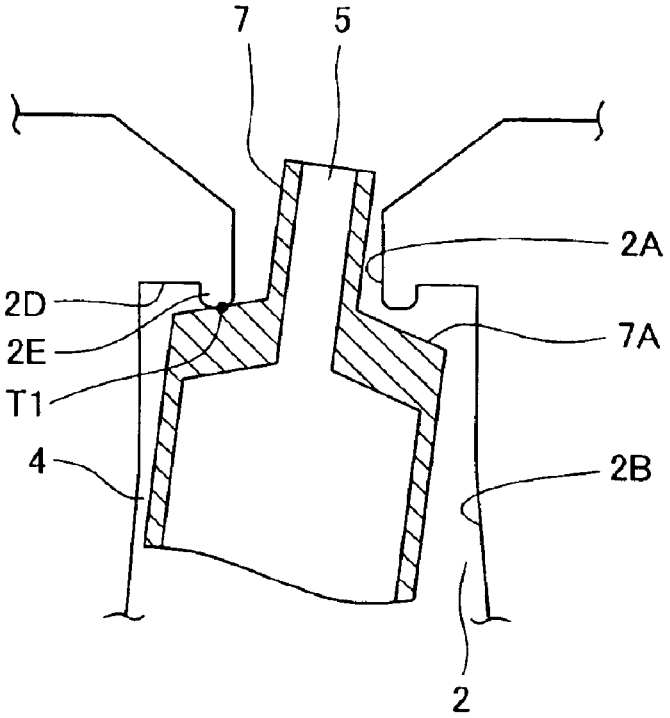

Next, the mode of nozzle contact in the ceiling wall 2D of the chamber 2 is explained. FIG. 21 is an explanatory diagram showing an enlargement of a relevant portion for explaining a modified example of the contact state of the ceiling wall 2D of the chamber 2 and the step end face 7A of the nozzle 4, wherein FIG. 21(*a*) shows the nozzle in a motionless state, and FIG. 21(*b*) shows the nozzle in an inclined state.

As illustrated in the diagram, the chamber 2 has a circular protrusion 2E at the ceiling wall 2D. This circular protrusion 2E is protruding toward the chamber side in continuance to the opening wall of the ceiling opening 2A, and contacts the step end face 7A of the nozzle 4. When the cleansing water is supplied to the chamber 2 and the nozzle 4 makes an elevated positional change and is inclined thereby, the nozzle 4 contacts this circular protrusion 2E at one point (contact portion T1) of the protruding portion of the circular protrusion 2E. Moreover, this contact portion T1 makes a transition around the ceiling opening pursuant to this nozzle revolution.

Therefore, since the contact of the nozzle 4 only occurs at the circular protrusion 2E, the point contact state involving this contact at the contact portion T1 can be stabilized, and this is further effective in abrasion prevention at the step end face 7A and circular protrusion 2E. In addition, even if abrasion occurs, in a state where the abrasive portion is limited to the circular protrusion 2E, the nozzle 4 can be made to point contact (contact) in a stable state by the circular protrusion 2E after the abrasion thereof, and this is effective in the stabilization of the nozzle inclination posture.

In such a case, if the step end face 7A is made to be a spherical shape or a tapered shape as described above, it would be further effective in the stabilization of the point contact and prevention of abrasion entailing the contact with the circular protrusion 2E.

Figure 22:
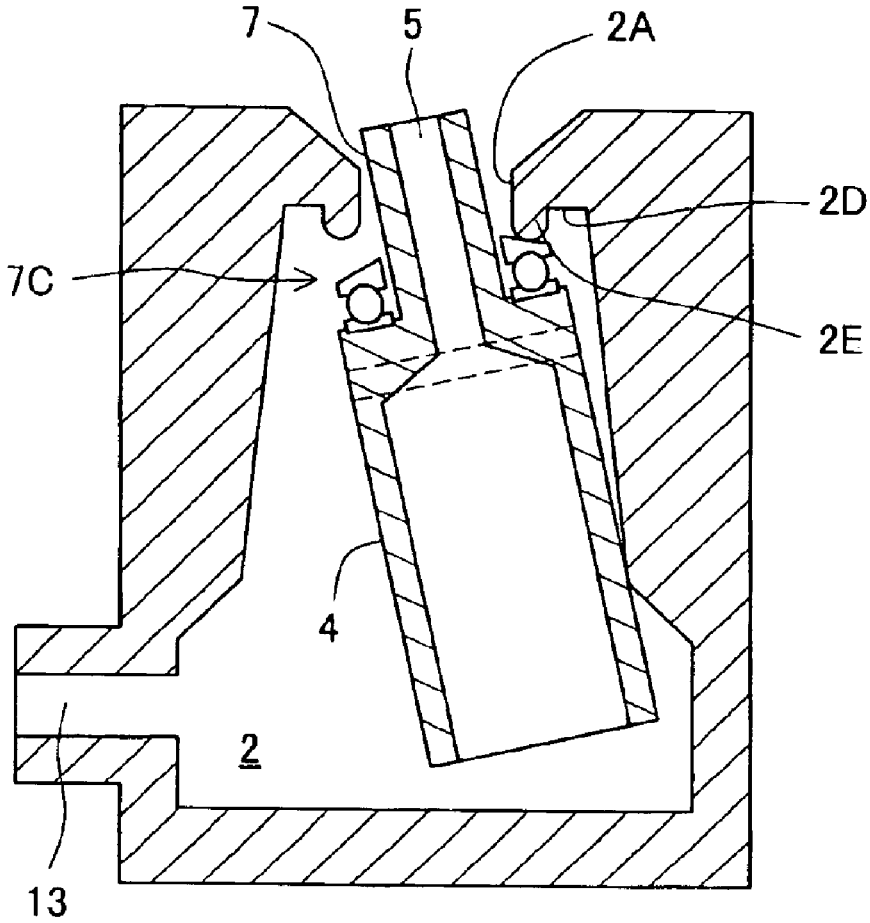
FIG. 22 is an explanatory diagram for explaining a modified example of the contact state of the ceiling wall 2D of the chamber and the nozzle 4.

Further, the nozzle contact at the ceiling wall 2D of the chamber 2 can also be modified as follows. FIG. 22 is an explanatory diagram for explaining a modified example of the contact state of the ceiling wall 2D of the chamber and the nozzle 4.

As illustrated in the diagram, the nozzle 4 has a thrust bearing 7C at the base of the condensed diameter member 7, and seeks the contact with the circular protrusion 2E with this bearing. With this, in addition to the rotation efficiency of the nozzle increasing, abrasion prevention of the circular protrusion 2E can be sought even more effectively. In this case, it further preferable that the upper side plate of the thrust bearing 7C is of a tapered shape as shown in the diagram, and it may also be formed in a spherical shape. Moreover, in addition to those having the circular protrusion 2E, the foregoing nozzle 4 can be built in a chamber 2 having a ceiling wall 2D that does not have this protrusion.

Figure 23A:
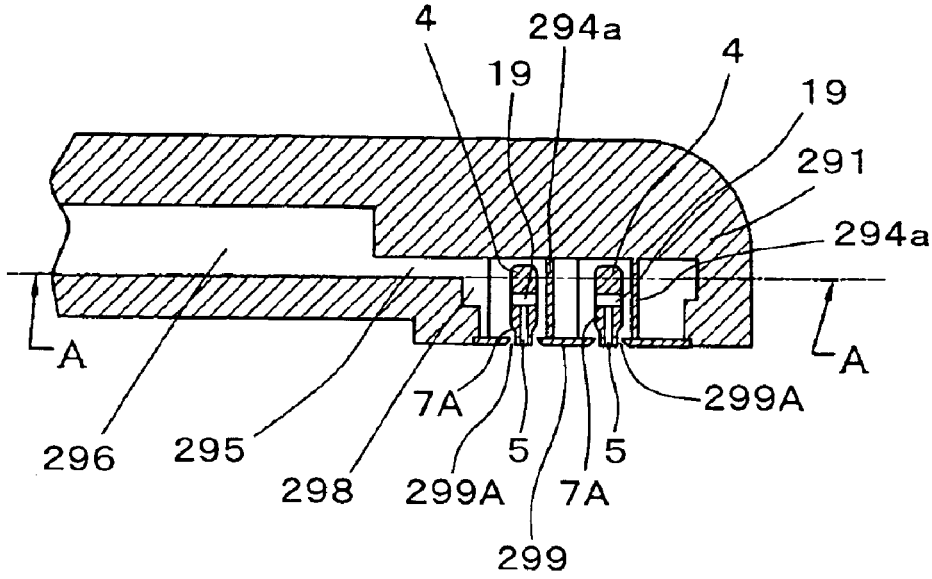
FIG. 23 is an explanatory diagram for explaining a shower device 291 employing the cleansing water jetting entailing nozzle revolution, wherein FIG. 23(*a*) is a lateral cross section of the shower device 291, and FIG. 23(*b*) is a cross section view of the shower device 291 along face A—A.
Figure 23B:
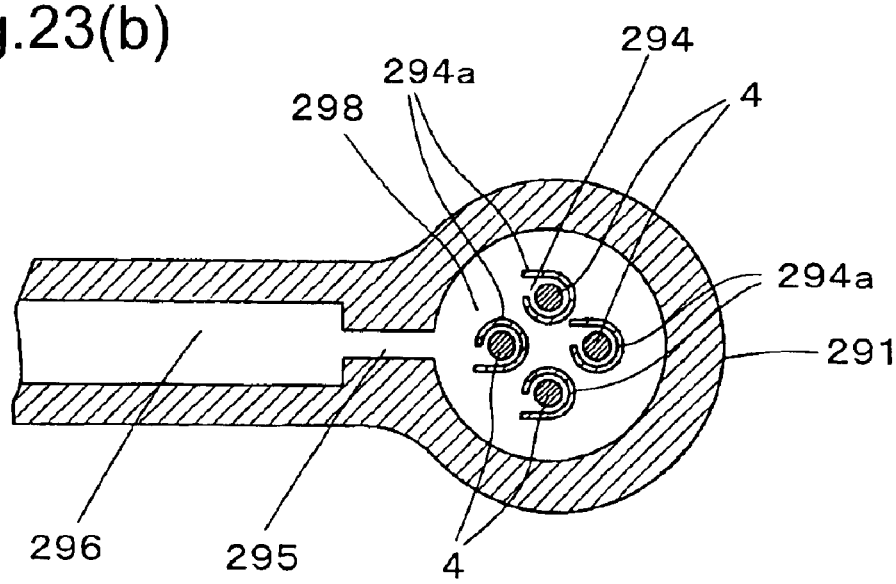
Figure 24:
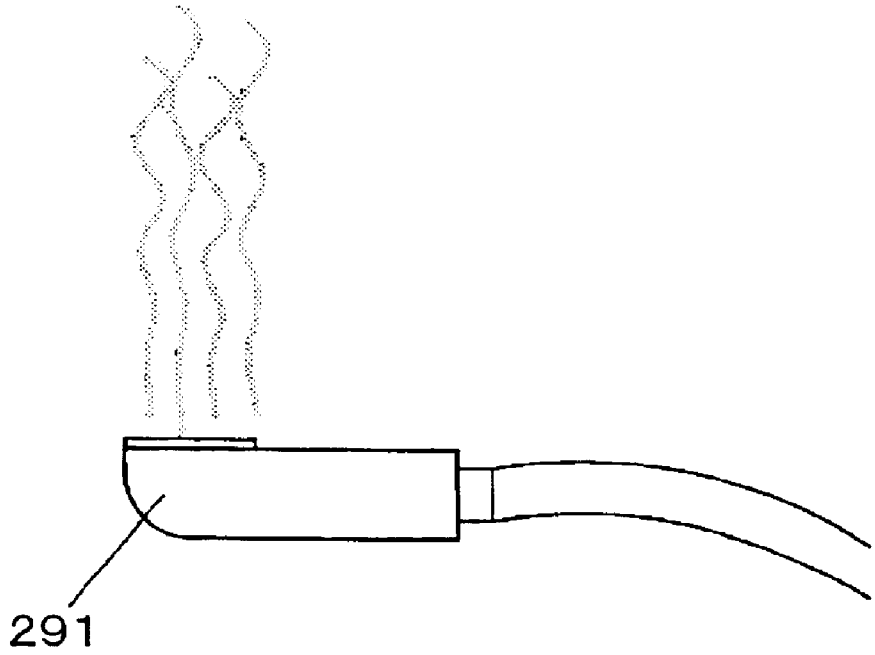
FIG. 24 is an explanatory diagram for explaining the jetting condition of the cleansing water from this shower device 291.

Next, another embodiment is explained. This embodiment employs the jetted cleansing water entailing the foregoing nozzle revolution to a device other than the human body part cleansing device. FIG. 23 is an explanatory diagram for explaining a shower device 291 employing the cleansing water jetting entailing nozzle revolution, wherein FIG. 23(*a*) is a lateral cross section of the shower device 291, and FIG. 23(*b*) is a cross section view of the shower device 291 along face A—A. FIG. 24 is an explanatory diagram for explaining the jetting condition of the cleansing water from this shower device 291.

As shown in FIG. 23(*a*), the shower device 291 comprises a water flow conduit 296 and a buffer chamber inflow conduit 295 having a conduit area narrower than such water flow conduit 296, and flows the cleansing water into the buffer chamber 298 with a high kinetic energy (i.e., at high speed). A plurality of chambers 294 is disposed inside the buffer chamber 298. Each chamber 294 is surrounded by a spiral guide 294*a* reaching the head cover 299, and such guide guides the cleansing water inside the chamber 294 along the inner wall of the guide from the opening portion thereof. Thus, the chamber 294 generates a vortical flow therein, and is exactly the same as the chamber 2 in the foregoing embodiment and modified examples and yields the same function (generation of vortical flow) thereof.

The head cover 299 comprises ceiling openings 299A in a dotted disposition, and each of the ceiling openings 299A is positioned roughly in the center of the bottom face of the foregoing chamber 294. Moreover, this ceiling opening 299A also has a depressed shape at the outer side thereof as with the ceiling opening 2A.

The nozzle 4 as illustrated in FIG. 13 is built in each of the chambers 294. This nozzle 4 makes its cleansing water jetting spout 5 protrude from the ceiling opening 299A to the outside thereof. Further, the nozzle 4 makes the step end face 7A contact the back face wall of the head cover around the ceiling opening 299A, and adopts the foregoing inclined posture in a state where the lower end of the nozzle side wall is in contact with the inner wall of the spiral guide 294*a*. This nozzle 4 comprises vertical and horizontal conduits 19 as described above, and guides and jets the cleansing water within the chamber 294 to and from the cleansing water jetting spout 5 at the nozzle tip via this conduit. In addition, although FIG. 23 depicts the nozzle 4 having the vertical and horizontal conduits 19 illustrated in FIG. 8, it can also have the nozzle penetration conduit 19 illustrated in FIG. 12.

Therefore, the cleansing water flows into the buffer chamber 298 from the buffer chamber inflow conduit 295, and, when such cleansing water flows into each of the chambers 294, this cleansing water produces a vortical flow around the nozzle 4 along the inner peripheral wall face of the chamber 294. Thereby, the foregoing lift acts on the nozzle 4, and the nozzle 4 revolves around the central axis of the ceiling opening 299A.

With the shower device 291 having the foregoing structure, since the nozzle 4 is revolved in each of the chambers 294, the cleansing water jetted from each of the nozzles 4 can be revolved and jetted as explained in FIG. 15. And, the spouted water from the entire shower device 291, as shown in FIG. 24, will be of a massed revolution jetting from the respective nozzles 4, and the cleansing water jetted from each of the nozzles 4 will be a revolution jetting independent from each other.

Therefore, this shower device 291 is also able to yield the same effects (broad-area jetting, miniaturization, etc.) as the embodiments and modified examples described earlier. In particular, since a shower device is used for a relatively long period of time for shampoo or the like, with this embodiment, the water conservation effect is increased through the broad-area jetting with a low amount of water supply.

Moreover, the revolution frequency of the nozzle 4 in each of the chambers 294 can also be made to be approximately 3 Hz or more by adjusting the flow velocity and so on as described above. With this, the revolution jetting from each of the nozzles 4 provides a feeling that the spouted water is making contact in an even manner, and, since such revolution jetting is massed, the overall shower spout is also able to provide a feeling of even contact.

Further, when the nozzle revolution frequency is increased to 40 Hz or more, it is possible to eliminate the uncomfortable feeling during the wash when cleansing is performed to an area sensitive to the human skin or to cut wounds or scratch wounds. If this frequency is made even larger, the spout water felt by the human body will come even closer to a feeling of the spout water contacting evenly throughout the entire water contact area. And, when the nozzle revolution frequency is made to be roughly 160 Hz, only a feeling of the water contacting evenly throughout the entire water contact area can be obtained.

As described above, larger the nozzle revolution frequency, the centrifugal force and air shearing applied to the jetted cleansing water increases, and this prevents the dispersion and scattering of the jetted cleansing water. Thus, when it is desirable to prevent the dispersion or scattering of the jetted cleansing water, the nozzle revolution frequency should be set to less than approximately 160 Hz and under.

With the foregoing shower device 291, although the contact of each nozzle 4 was sought at the head cover 299, this is not limited thereto. For instance, a plurality of chambers 294 can be directly formed on the showed device 291 without providing a buffer chamber 298, and cleansing water can be made to branch and flow into each of the chambers. Moreover, the nozzle 4 to be built in each of the chambers 294 can be formed as a nozzle having only the large diameter member 4A without comprising the condensed diameter member 7 as illustrated in FIG. 14 and FIG. 15. With this, since the nozzle does not protrude outside the head cover 299, the nozzle does not contact the washing portion even when the shower device 291 is close to the washing portion. Thus, it is possible to prevent a situation where the nozzle revolution is stopped from the outside, and hindrance to the jetting of cleansing water can be prevented thereby. Thus, an uncomfortable feeling does not occur during the shower.

Figure 25:
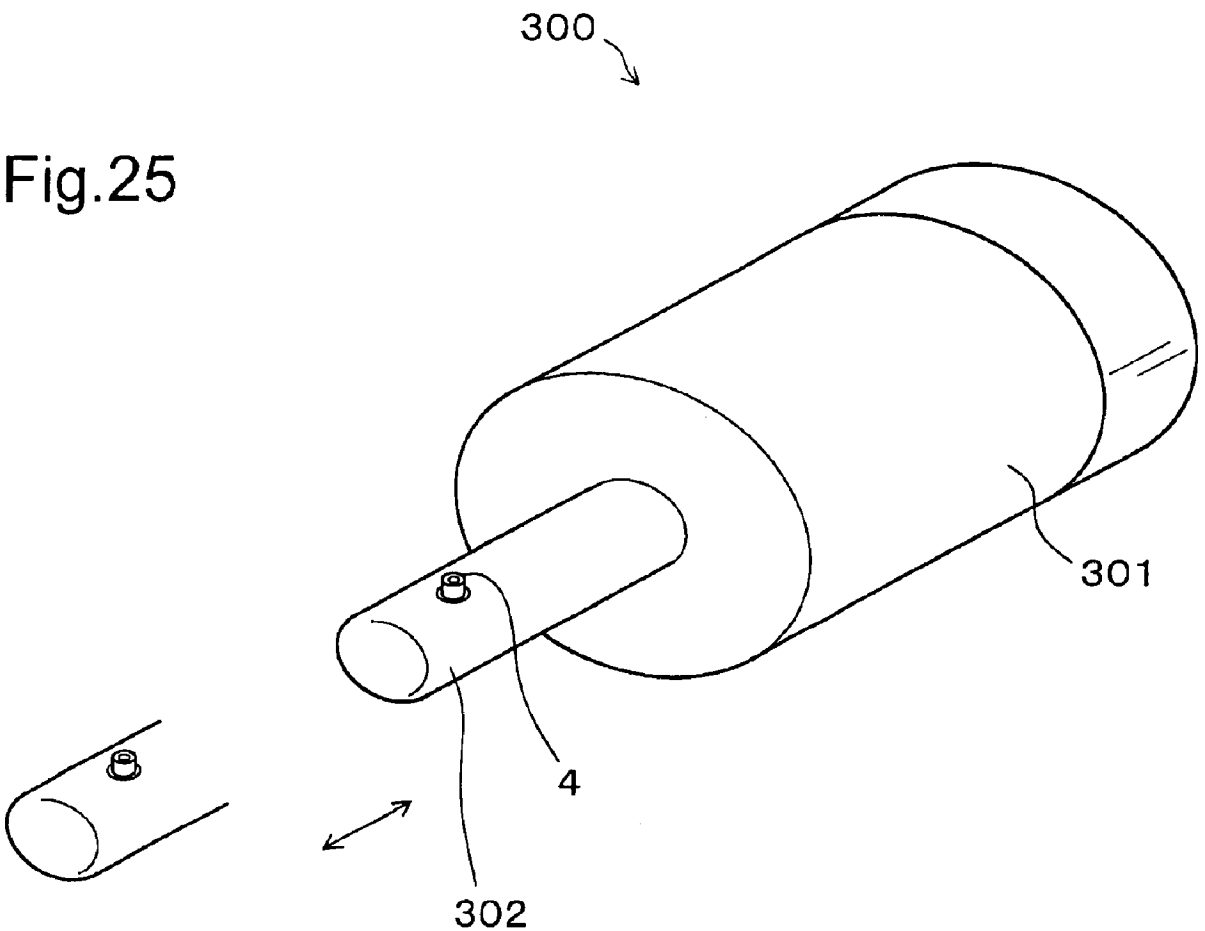
FIG. 25 is a schematic perspective view of a portable human body part cleansing device 300 employing the revolution jetting entailing nozzle revolution.

Next, another example of the revolution jetting of the cleansing water entailing nozzle revolution is explained. FIG. 25 is a schematic perspective view of a portable human body part cleansing device 300 employing the revolution jetting entailing nozzle revolution.

As illustrated in the diagram, this human body part cleansing device 300 has a tank 301, and a nozzle arm 302 that is extendable forward and back against such tank. When the cleansing water inside the tank 301 is pushed out with grasping the tank or pump having a dry battery as its power source, the nozzle arm 302 receives this water pressure and advances forward to a predetermined location, and then jets cleansing water thereafter.

This nozzle arm 302 comprises a chamber not shown and the foregoing nozzle 4 at the nozzle tip side, wherein this nozzle 4 is provided revolvably in an inclined posture within the chamber as described above. And, as a result of supplying such cleansing water to the chamber and generating a vortical flow, the revolution jetting of the cleansing water during the cleansing of a body part is realized.

With this human body part cleansing device 300, since the nozzle revolution and jetting are produced based on the vortical flow, it is possible to resolve the displeasure of the cleansing water within the tank 301 running out as a result of the improved water conservation as described above. In addition, this is favorable for portability due to the lightness in weight without the requirement of an actuator or the like, and, while it is a portable type device, the expansion of the cleansing area and improvement in cleansing power can simultaneously be conducted.

Figure 26:
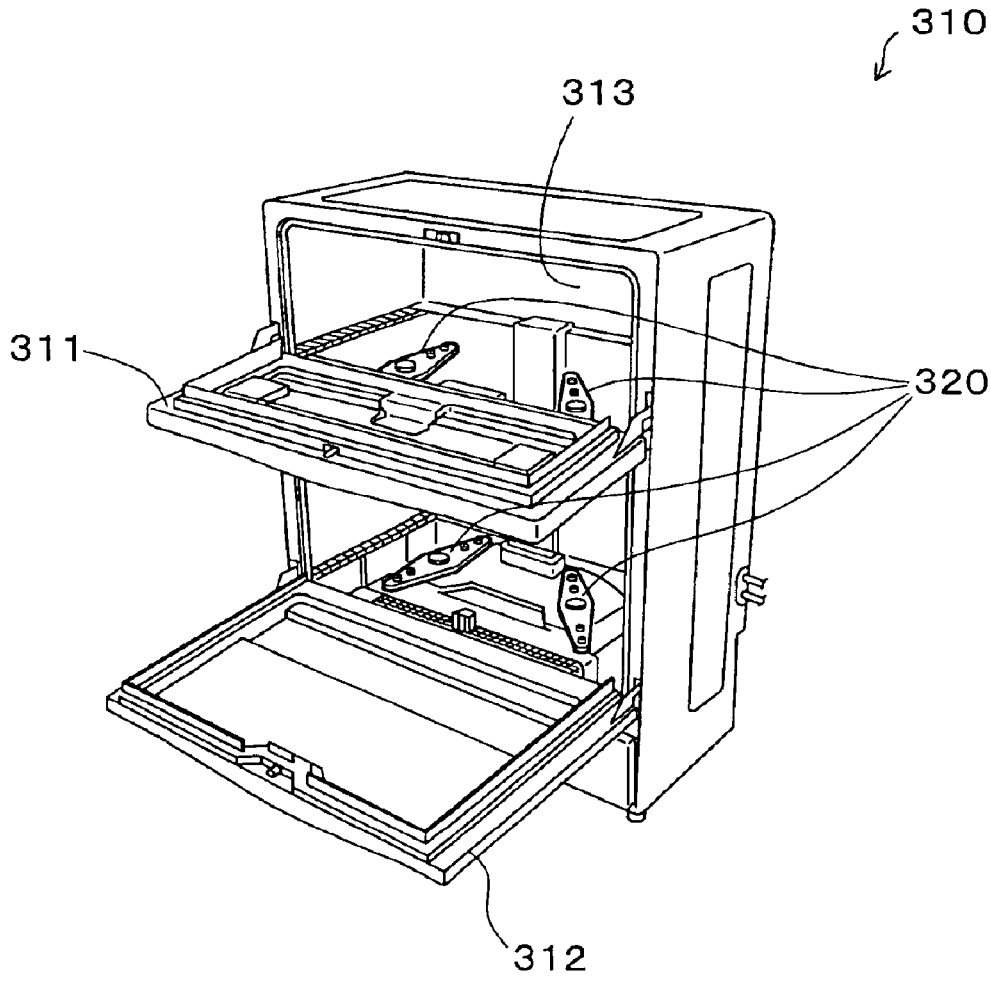
FIG. 26 is a schematic perspective view of a dishwashing device employing the revolution jetting of cleansing water entailing nozzle revolution.

Next, another example of the revolution jetting of cleansing water is explained. FIG. 26 is a schematic perspective view of a dishwashing device employing the revolution jetting of cleansing water entailing nozzle revolution, and FIG. 27 is an explanatory diagram for explaining a rotatable washing arm 320 having this dishwashing device 310.

As illustrated in the diagrams, the dishwashing device 310 comprises front side upper and lower doors 311, 312, and these doors are used to open and close the washing chamber 313. This washing chamber 313 is provided with two rotatable washing arms 320 capable of jetting cleansing water while rotating at the upper and lower rows thereof.

This rotatable washing arm 320 is supported with a pillar 321 freely rotatable at the center thereof, and both the left and right ends with such pillar 321 therebetween is provided with two nozzles 4 each. This nozzle 4 has the foregoing chamber 2, and a water supply conduit not shown for supplying cleansing water from the tangent direction and generating a vortical flow of the cleansing water is provided to the respective chambers 2. Here, the chamber 2 and the nozzle 4 may be of various types described in the foregoing embodiments or modified examples thereof. For instance, the foregoing structure may employ the chamber 2 and nozzle 4 illustrated in FIGS. 8 to 13 or FIGS. 13 to 22.

Figure 27:
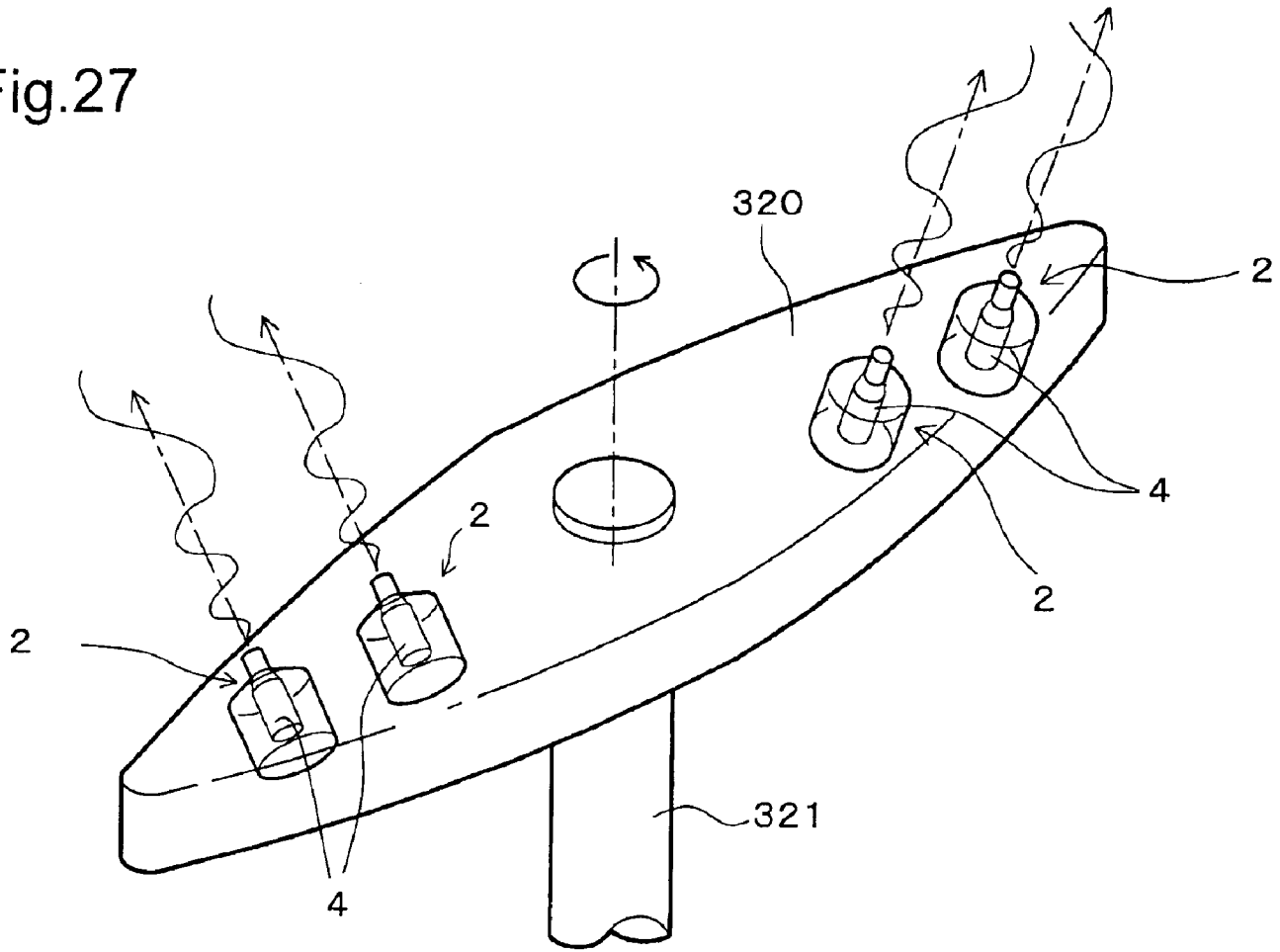
FIG. 27 is an explanatory diagram for explaining a rotatable washing arm 320 having this dishwashing device 310.

This dishwashing device 310 has each of the nozzles 4 illustrated in FIG. 27 with the orientation direction of jet thereof facing diagonally, and the left/right jet nozzles of rotatable washing arms 320 have opposite orientation directions of jet. In other words, the nozzle 4 on the left side of the diagram jets cleansing water to the back side of the drawing, and the nozzle 4 on the right side jets cleansing water toward the front side of the drawing. Thus, when cleansing water is jetted from the respective nozzles at the left and right ends of the rotatable washing arm 320, the reactive force generated from this jetted cleansing water works in the same direction as the rotatable washing arm 320.

In order to make the orientation direction of the cleansing water to be jetted to an oblique direction, the central axis of the ceiling opening not shown in the chamber 2 can be formed obliquely together with this orientation direction.

With this dishwashing device 310, each of the nozzles 4 at the left and right rotatable washing arms generates a nozzle revolution in an inclined posture entailing the supply of cleansing water, and the jetting of cleansing water as illustrated in FIG. 15 is thereby realized.

With this dishwashing device 310 also, since each of the nozzles 4 is generating a revolution jetting, as described above, improvement in water conservation efficiency, improvement in washing performance (stain removal performance of dishes), expansion of washing area (water contact area) and so on may be sought. In particular, from the perspective of dishwashing, the advantage of exhibiting high washing performance with less cleansing water is preferable.

The foregoing nozzle 4 can be fixed and established on the wall face of the washing chamber 313 as necessary. For example, the tableware of pot-steamed hotchpotch, in which the stain thereof is difficult to remove, is stored in a powerful washing basket of the washing chamber 313, and cleansing water is jetted (revolution jetting) from the nozzle 4, which is fixed to the wall face, toward the powerful washing basket. With this, even the tableware of such pot-steamed hotchpotch can be washed favorably with high washing power. In addition, with this kind of nozzle fixed to the wall face, the existing ordinary nozzle can be removed, and the foregoing nozzle 4 and chamber 2 can be incorporated in place thereof. According to this method, an existing dishwashing device can be easily modified to be superior in water conservation, and to have high washing power.

Moreover, the foregoing dishwashing device 310 yields the following advantages.

When water is jetted from each of the nozzles 4 of the foregoing rotatable washing arm 320, this rotatable washing arm 320 rotates by the reactive force of such jetted water. Thus, cleansing water can be jetted to the dishes from the respective nozzles 4 by the nozzle revolution while rotating the rotatable washing arm 320. Thus, in addition to improving the washing performance of dishes and the like, cleansing water can be jetted to the four corners of the washing chamber 313 upon washing the dishes.

Further, in the foregoing rotatable washing arm 320, the chamber 2 adopts a posture inclined against the rotatable washing arm 320, and the nozzle 4 is built in this chamber 2. Therefore, the built-in nozzle 4 will be inclined in the chamber 2 during a non-washing state, and a narrow portion of an interval will be formed between the nozzle outer wall face and the chamber inner wall face.

Therefore, when cleansing water is supplied to the chamber 2 from the tangent direction under the foregoing state, the flow velocity of the vortical flow will increase at the narrow portion of the foregoing intervals. It is thereby possible to generate a flow velocity difference with certainty around the nozzle 4, and the reliability of the revolution jetting can thereby be increased. In addition, since the nozzle 4 inclined against the chamber 2 from the beginning, collision of the vortical flow will occur from the initial stages of inflow, and the nozzle 4 will be pushed by the vortical flow. Thus, the nozzle 4 immediately produces a nozzle revolution, and revolution jetting can be commenced from the initial stages of supplying cleansing water.

Here, in a state where the chamber 2 and nozzle 4 are relatively inclined against each other prior to the start of washing, the foregoing embodiments and modified examples thereof can be easily realized. For instance, with the human body part cleansing device illustrated in FIG. 2, since the nozzle arm 31 advances and retreats obliquely, the nozzle 4 at the arm tip of the cleansing water jetting device 40 will be inclined against the chamber 2 thereof, and the foregoing advantages can thereby be yielded.

Moreover, although the rotatable washing arm 320 was rotated with the reactive force of the spouted water in the foregoing dishwashing device 310, the method is not limited thereto. For instance, the rotatable washing arm 320 can be rotated with a motor or the like, and the nozzle 4 can be disposed facing upward to this rotatable washing arm 320.

Or, in addition to providing the nozzle 4 facing upward on the upper face of the rotatable washing arm 320, another nozzle 4 can be provided to the side face of the rotatable washing arm 320. With this, the nozzle 4 on the side face washes the dishes on the side of the rotatable washing arm 320 and simultaneously rotates the rotatable washing arm 320 with the reactive force of such jetting. Meanwhile, the nozzle 4 on the upper face washes the dishes on the upper part with the rotatable washing arm 320.

Figure 28:
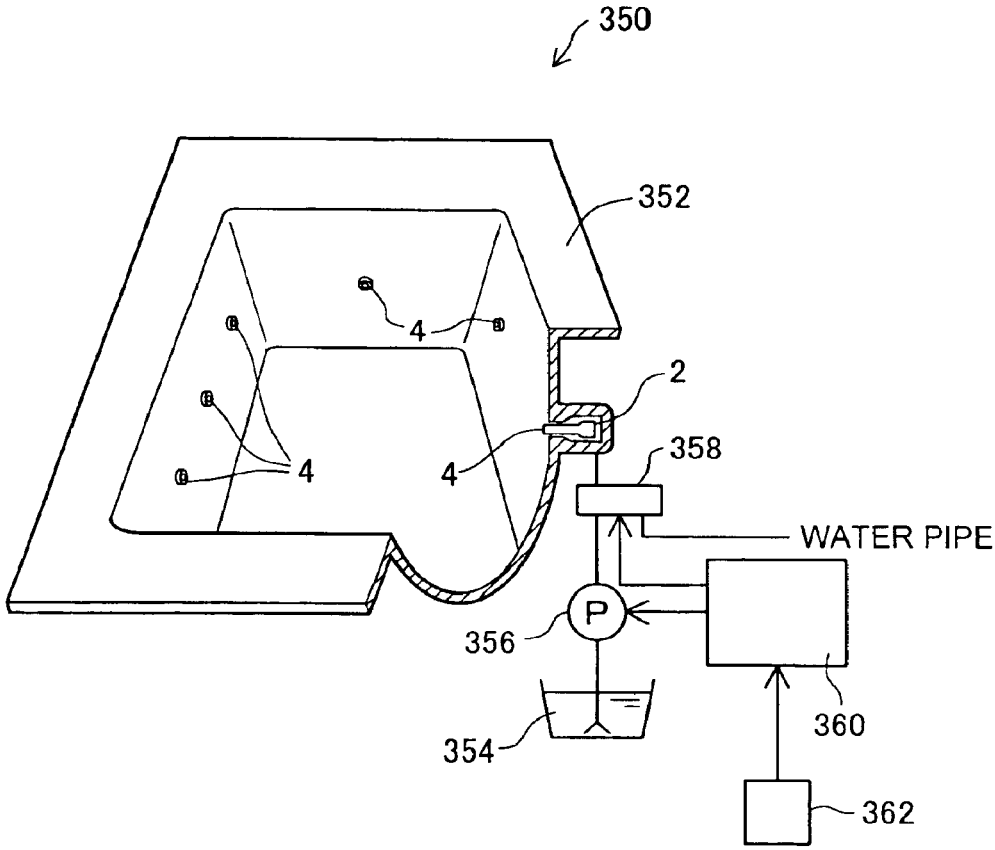
FIG. 28 is an explanatory diagram for explaining the schematic structure of a bathtub washing device employing the revolution jetting of cleansing water entailing nozzle revolution.
Figure 29:
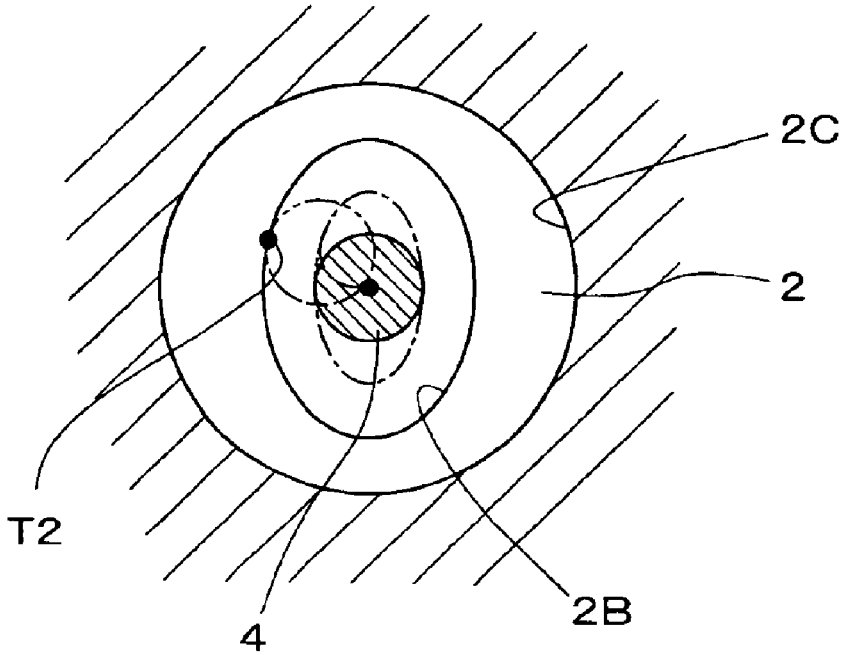
FIG. 29 is an explanatory diagram for explaining the condition of restricting the inclination of the nozzle 4 with a guide hole portion 2B having the chamber 2 adopted in this bathtub washing device 350.

Next, another example of the revolution jetting of cleansing water is explained. FIG. 28 is an explanatory diagram for explaining the schematic structure of a bathtub washing device 350 employing the revolution jetting of cleansing water entailing nozzle revolution, and FIG. 29 is an explanatory diagram for explaining the condition of restricting the inclination of the nozzle 4 with a guide hole portion 2B having the chamber 2 adopted in this bathtub washing device 350.

As illustrated in the diagrams, the bathtub washing device 350 comprises chambers 2 at a plurality of locations on the inner peripheral wall of a bathtub 352, and jets detergent and cleansing water (tap water) toward the opposite inner peripheral wall of the bathtub form the nozzle 4 built in the chamber. This bathtub washing device 350 has a switching valve 358 for switching the cleansing water supply from the water pipe and the detergent supply from the detergent tank 354 with a pump 356. This switching valve 358 controls the switching of the water supply with a control device 360, and the bathtub washing operation including this water supply switching is conducted with instructions from a remote control 362. In addition, a check valve for preventing the backflow is provided to the cleansing water supply water pipe and the detergent supply water pipe positioned upstream of the switching valve 358, respectively.

The chamber 2 of the present embodiment, as described in FIG. 13, prescribes the nozzle inclination posture with the contact portion T1 of the ceiling wall 2D and the contact portion T2 of the guide hole portion 2B. And, as shown in FIG. 29, the chamber 2 is of an oval shape with the guide hole portion 2B, which yields the nozzle contact at the contact portion T2, in the horizontal cross section, and this oval shaped guide hole portion 2B restricts the inclination of the nozzle 4. In other words, although the nozzle 4 commences the vortical flow in the foregoing chamber, pursuant to the contact with the guide hole portion 2B, it revolves in a path of the dashed line simulating an opening shape. Thus, the bathtub washing device 350 makes the cleansing water jetted from the respective nozzles 4 to be in a flat conical shape. Here, this flat direction will be a horizontal direction in the inner peripheral wall of the bathtub, and the location for disposing the nozzle 4 and chamber 2 will be near the common water level of the inner peripheral wall of the bathtub.

Here, when an operation is made with the remote control 362 to start the bathtub washing, the control device 360 switches the switching valve 358 to the detergent supply upon receiving the signal thereof, and drives the pump 356 to supply the detergent. With this, the inner peripheral wall of the bathtub receives the jetting of the detergent from the respective nozzles 4 across the inner peripheral wall of the bathtub in an area including the vicinity of the common water level. When such detergent is supplied for a prescribed amount of time, the control device 360 stops the pump, switches the switching valve 358 to the cleansing water supply, and supplies such cleansing water. Thereby, the inner peripheral wall of the bathtub receives the splashing of the cleansing water from the respective nozzles 4 across the inner peripheral wall of the bathtub in an area including the vicinity of the common water level. And, the control device 360 alternately repeats such detergent jetting and cleansing water jetting, thoroughly supplies the cleansing water at the final stage of washing, and completes the washing operation of the inner peripheral wall of the bathtub.

Therefore, according to the bathtub washing device 350 of the present embodiment, the bathtub can be washed favorably since cleansing water and the detergent are splashed on the inner peripheral wall of the bathtub mainly in the vicinity of the common water level where adhesion of soil is most significant. In addition, during the washing of the bathtub, the foregoing effects (improvement of water conservation, improvement in washing performance, etc.) of the nozzle 4 that jets cleansing water pursuant to the nozzle revolution can be exhibited.

Although the embodiments of the present invention were described above, the present invention shall in no way be limited to the foregoing embodiments and modes of carrying out the invention, and it goes without saying that the present invention may be worked in various modes within the scope of the gist hereof. For instance, the numerical values cited in the embodiments and modified examples are merely illustrative, and the present invention shall not be limited to such exemplified numerical values. Further, the nozzle 4 revolving in the foregoing inclined posture can be provided with a cleansing water jetting spout 5 and conduit 19 inclined against the central axis of the nozzle as illustrated in FIG. 4. According to this structure, the cleansing water jetting in a conical shape entailing the nozzle revolution will be further jetted in a conical shape entailing the nozzle rotation at the conical peripheral wall thereof. Thus, cleansing water can be jetted to an even broader area.

Moreover, without limitation to the foregoing cleansing water jetting device, the present invention may also be employed in a fluid jetting device to be used for a different purpose, as in a fountain for example. Further, the fluid is not limited to water.

INDUSTRIAL APPLICABILITY

The fluid jetting device of the present invention is applicable to a cleansing water jetting device for jetting supplied cleansing water from a nozzle, or various washing devices applying such water jetting device; for example, a human body part cleansing device or a shower device, a dishwashing device, a bathtub washing device, and so on.

What is claimed is:

1. A liquid jetting device including a chamber for receiving liquid, and for jetting the supplied liquid from a liquid jetting spout, the liquid jetting device comprises;

a nozzle built in the chamber, the nozzle having the liquid jetting spout at the a nozzle tip side, and having a nozzle inner conduit for guiding the liquid supplied by the chamber to the liquid jetting spout;

a condensed diameter member formed on the nozzle that is rotatably inserted into an opening formed on the chamber and in a state where the a position change of the nozzle toward the axial core direction of the nozzle is allowed and wherein said condensed diameter member protrudes outside from said opening; and a guide extending from said chamber, the guide contacting and guiding the nozzle so as to make the nozzle revolve around the central axis in a posture inclined against the central axis of the opening;

wherein when the liquid is supplied to the chamber, the nozzle changes its position toward the outer side of the nozzle tip by the force of liquid pressure, an end face of the nozzle portion having a larger diameter than the condensed diameter member contacts the chamber ceiling wall of the opening side, and the nozzle rotates around the axial core by the force of liquid pressure in such contact state and jets the liquid from the liquid jetting spout while revolving around the central axis in a posture inclined against the central axis; and in a state where the nozzle changed its position toward the outer side of the nozzle tip by the force of liquid pressure, the condensed diameter member and the opening are formed such that the liquid leaking through a gap, which is formed around the opening between the condensed diameter member and the opening, from within the chamber to the outside of the opening, wherein said gap is designed to allow said leaking liquid to provide a lubricant to reduce rotational resistance and thereby prevents the interference with the liquid jetted from the liquid jetting spout.

2. A liquid jetting device according to claim 1, wherein the end face of the nozzle portion having a diameter larger than the condensed diameter member is formed in a sphere.

3. A device for jetting liquid from a liquid jetting spout, comprising:

a chamber for receiving a supply of liquid;

a nozzle built in the chamber, the nozzle having the liquid jetting spout at a nozzle tip side, and having a nozzle inner conduit for guiding the liquid supplied by the chamber to the liquid jetting spout, wherein the nozzle makes the liquid jetting spout locate to the outside of the ceiling opening formed on the chamber, adopts a posture inclined against the central axis of the ceiling opening upon making contact with one place of the chamber ceiling wall of the ceiling opening side and making contact with at least another place, and is built in the chamber revolvably around the central axis in the inclined posture; and when the liquid is supplied to the chamber, the nozzle jets liquid from the liquid jetting spout via the nozzle inner conduit while revolving around the central axis in a state of adopting the inclined posture by the force of liquid pressure of the supplied liquid, and, by taking the inclined posture, forms a gap between said nozzle tip and the chamber ceiling wall around the ceiling opening, wherein said gap is designed to leak the liquid from within the chamber through the gap providing a lubricant to reduce rotational resistance and thereby prevent interference with the jetted from the liquid jetting spout.

4. A liquid jetting device according to claim 3, wherein the nozzle makes contact with the another place by contacting the chamber side wall around the nozzle, and adopts the inclined posture at two places of the chamber side wall contact portion and the chamber ceiling wall contact portion.

5. A liquid jetting device according to claim 4, wherein the nozzle has a nozzle tip with a diameter smaller than the ceiling opening, and a nozzle body having a diameter larger than the ceiling opening and continued to the nozzle tip, the nozzle tip protrudes outside from the ceiling opening so as to make the liquid jetting spout locate to the outside of the ceiling opening, and the nozzle adopts the inclined posture by making the step portion of the nozzle tip and the nozzle body contact the chamber ceiling wall, and making the nozzle body contact the chamber side wall.

6. A liquid jetting device according to claim 3, wherein the nozzle has a nozzle tip with a diameter smaller than the ceiling opening, and a nozzle body having a diameter larger than the ceiling opening and continued to the nozzle tip, the nozzle tip protrudes outside from the ceiling opening so as to make the liquid jetting spout locate to the outside of the ceiling opening, the nozzle makes contact with the another place by contacting the ceiling opening wall around the nozzle, and adopts the inclined posture at two places of the ceiling opening wall contact portion and the chamber ceiling wall contact portion; and the nozzle tip contacts the ceiling opening wall, and the step portion of the nozzle tip and the nozzle body contacts the chamber ceiling wall.

7. A liquid jetting device according to claim 6, wherein the nozzle adopts the inclined posture by making contact with the ceiling opening wall and making contact with the chamber ceiling wall, as well as by making the nozzle body contact the chamber side wall.

8. A liquid jetting device according to claim 3, wherein the nozzle moves to the ceiling opening side and makes contact with the chamber ceiling wall upon being subject to the liquid pressure involving the supply of liquid to the chamber.

9. A liquid jetting device according to claim 3, wherein the chamber ceiling wall circularly protrudes the contact portion with the nozzle.

10. A liquid jetting device according to claim 3, wherein the nozzle has a shape of either a sphere or a taper at the contact portion with the chamber ceiling wall.

11. A liquid jetting device according to claim 3, wherein the nozzle has the nozzle inner conduit penetrating in the axial center direction of the nozzle.

12. A liquid jetting device according to claim 11, wherein the nozzle makes the nozzle inner conduit on the side opposite to the liquid jetting spout a tube path with a large diameter.

13. A liquid jetting device according to claim 3, wherein at least one of the chamber ceiling wall and the contact portion of the nozzle to the chamber ceiling wall is formed of a metal material.

14. A human body part cleansing device for jetting supplied cleansing water toward a human body part, the human body part cleansing device comprising:

a nozzle arm positioned at a cleansing position upon cleansing the body part; and the liquid jetting device according to claim 1, wherein the liquid jetting device is built in the nozzle arm so as to jet cleansing water from the nozzle toward the human body part.

15. A shower device for jetting supplied cleansing water toward a human body, the shower device comprising;

a liquid jetting device according to claim 1, and a showerhead, wherein the liquid jetting device is built in the showerhead so as to jet cleansing water from a nozzle, which is included in the liquid jetting device, toward the human body.

16. A washing device for jetting supplied cleansing water toward an object to be washed, the washing device comprising a liquid jetting device according to claim 1 so as to jet cleansing water from a nozzle, which is included in the liquid jetting device, toward the object to be washed.

17. A washing device according to claim 16, wherein the liquid jetting device directs the nozzle toward a washing chamber which stores the object to be washed.

18. A washing device according to claim 17, the washing device further comprises a rotating arm disposed in the washing chamber rotatably around the rotational axis, wherein the rotating arm has the liquid jetting devices disposed at the arm tip portion with the rotational axis therebetween, and a supply conduit for supplying cleansing water to the chamber of each of the liquid jetting devices, and each of the liquid jetting devices jets cleansing waxer from the nozzle while orienting toward the oblique direction against the rotating arm such that the reactive force produced with the jetting of cleansing water yields the same directional rotation to the rotating arm as the rotational axis rotation.

19. The device of claim 1 wherein the nozzle body includes a cavity arranged on an opposite side of the nozzle from the condensed diameter member; and wherein the guide extends from the chamber into the cavity of the nozzle body to contact and guide the nozzle so as to make the nozzle revolve around the central axis in a posture inclined against the central axis of the opening.

20. A liquid jetting device according to claim 1, wherein the opening formed in the chamber has a first diameter and wherein the nozzle is formed having a diameter less than the first diameter of the chamber opening.

21. A device for jetting liquid from a nozzle spout, the device comprising:

a chamber for receiving a supply of liquid, the chamber including a wall having an opening formed therein;

a nozzle built in the chamber, the nozzle having a nozzle body and a liquid jetting nozzle spout and having a nozzle inner conduit for guiding the liquid supplied by the chamber to the liquid jetting nozzle spout, wherein the nozzle is revolvably arranged in the chamber so that the nozzle body contacts the wall and the nozzle spout extends through the ceiling opening such that the nozzle is inclined against a central axis of the ceiling opening and such that the nozzle body contacts ceiling wall and contacts the chamber in at least another place;

when the liquid is supplied to the chamber, the nozzle jets the liquid out of the nozzle spout via the nozzle inner conduit while revolving the nozzle around the central axis in a state of inclined posture that is maintained by the pressure of the supplied liquid; and wherein the inclined posture orients the nozzle such that a gap is formed between the nozzle body and the chamber wall around the opening, wherein the gap is designed to facilitate the leaking of liquid from within the chamber through the gap to provide lubrication that reduces rotational resistance and prevents interference with the fluid jetted out from the nozzle spout.

22. The device of claim 21 wherein a contact surface of the nozzle body has a curved contour; and wherein the nozzle is arranged in the chamber so that the contact surface of the nozzle body contacts the chamber wall and the nozzle spout extends through the chamber opening.

23. The device of claim 22 wherein only a portion of the curved contact surface contacts the chamber wall thereby increasing the size of gap formed between the nozzle body and the chamber wall around the opening to further facilitate the leaking of liquid from within the chamber through the gap.

24. The device of claim 22 wherein the curved contact surface comprises a spherical contact surface.

25. The device of claim 21 wherein device includes a guide arranged to contact and guide time nozzle so as to make the nozzle revolve around the central axis in a posture inclined against the central axis of the opening.

26. The device of claim 25 wherein a chamber wall includes a cavity;

wherein the nozzle body includes a guide pin arranged on an opposite side of the body from the nozzle spout; and wherein the guide includes the guide peg extending from the nozzle body into the chamber wall cavity to contact and guide the nozzle so as to make the nozzle revolve around the central axis in a posture inclined against the central axis of the opening.

27. Time device of claim 25 wherein the nozzle body includes a cavity arranged on an opposite side of the body from the nozzle spout; and wherein the guide includes a guide peg that extends from the chamber into the cavity of the nozzle body to contact and guide the nozzle so as to make the nozzle revolve around the central axis in a posture inclined against the central axis of the opening.

28. The device of claim 27 wherein the cavity of the nozzle body facilitates the passage of the fluid into the nozzle body to the nozzle inner conduit for jetting out through the nozzle spout.

29. The device of claim 21 wherein chamber wall includes a circular protrusion proximal to an edge of the opening;

wherein the nozzle is revolvably arranged in the chamber so that the nozzle body contacts the circular protrusion and the nozzle spout extends through the chamber opening such that the nozzle is inclined against a central axis of the chamber opening; and wherein the inclined posture orients the nozzle such that a gap is formed between the nozzle body and the protrusion around chamber opening to facilitate the leaking of liquid from within the chamber through the gap to provide lubrication that reduces rotational resistance and prevents interference with the fluid jetted out from the nozzle spout.

30. A liquid jetting device according to claim 21, wherein the opening fanned in the chamber has a first diameter and wherein the condensed diameter member is formed having a diameter less than the first diameter of the chamber opening.

* * * * *

UNITED STATES PATENT AND TRADEMARK OFFICE

CERTIFICATE OF CORRECTION

PATENT NO. : 6,925,659 B2
DATED : August 9, 2005
INVENTOR(S) : Sato et al.

It is certified that error appears in the above-identified patent and that said Letters Patent is hereby corrected as shown below:

Column 32,
Line 31, change “the a nozzle” to -- the nozzle --.
Line 36, change “the a position” to -- the position --.

Column 33,
Line 25, change “the jetted” to -- the liquid jetted --.

Column 34,
Line 52, change “cleansing waxer” to -- cleansing water --.

Column 35,
Line 47, change “guide time nozzle” to -- guide the nozzle --.

Column 36,
Line 13, change “Time device” to -- The device --.

Signed and Sealed this

Twenty-seventh Day of December, 2005

JON W. DUDAS
*Director of the United States Patent and Trademark Office*